US009777940B2

(12) United States Patent
Yasutomi

(10) Patent No.: US 9,777,940 B2
(45) **Date of Patent: *Oct. 3, 2017**

(54) AIRFLOW DIRECTION CONTROL DEVICE OF AIR CONDITIONING INDOOR UNIT

(75) Inventor: Masanao Yasutomi, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 391 days.

This patent is subject to a terminal disclaimer.

(21) Appl. No.: 14/368,491

(22) PCT Filed: Aug. 31, 2012

(86) PCT No.: PCT/JP2012/072129

§ 371 (c)(1),
(2), (4) Date: Jun. 24, 2014

(87) PCT Pub. No.: WO2013/099353

PCT Pub. Date: Jul. 4, 2013

(65) Prior Publication Data

US 2015/0153063 A1 Jun. 4, 2015

(30) Foreign Application Priority Data

Dec. 28, 2011 (JP) ..... 2011-288530

(51) Int. Cl.
*F24F 13/10* (2006.01)
*F24F 1/00* (2011.01)
*F24F 11/00* (2006.01)

(52) U.S. Cl.
CPC ..... *F24F 13/10* (2013.01); *F24F 1/0011* (2013.01); *F24F 11/0078* (2013.01); *F24F 2001/0048* (2013.01); *F24F 2221/28* (2013.01)

(58) Field of Classification Search
USPC ..... 454/322
See application file for complete search history.

(56) References Cited

FOREIGN PATENT DOCUMENTS

| | | | |
|---|---|---|---|
| EP | 1 553 358 | A1 | 7/2005 |
| JP | 55-100403 | A | 7/1980 |
| JP | 61-122447 | A | 6/1986 |
| JP | 5-79690 | A | 3/1993 |
| JP | 10-19300 | A | 1/1998 |
| JP | 2003-232560 | A | 8/2003 |
| JP | 2004-101128 | A | 4/2004 |

(Continued)

OTHER PUBLICATIONS

International Preliminary Report of corresponding PCT Application No. PCT/JP2012/072129 dated Jul. 10, 2014.

(Continued)

*Primary Examiner* — Gregory Huson
*Assistant Examiner* — Martha Becton
(74) *Attorney, Agent, or Firm* — Global IP Counselors, LLP

(57) ABSTRACT

An air conditioning indoor unit includes a casing having an air outlet, a horizontal blade, a Coanda blade and a control unit. The horizontal blade changes an up and down direction flow of outlet air blown out from the air outlet. The Coanda blade cooperates with the horizontal blade in order to utilize the Coanda effect to change the outlet air to a Coanda airflow along a predetermined surface. The control unit changes postures of the Coanda blade and the horizontal blade to predetermined postures that change some of the outlet air to the Coanda airflow and do not change a remainder of the outlet air to the Coanda airflow.

14 Claims, 20 Drawing Sheets

(56) References Cited

FOREIGN PATENT DOCUMENTS

| | | | |
|---|---|---|---|
| JP | 2006-162215 | A | 6/2006 |
| JP | 2007-192480 | A | 8/2007 |
| WO | 2006/061974 | A1 | 6/2006 |

OTHER PUBLICATIONS

International Search Report of corresponding PCT Application No. PCT/JP2012/072129 dated Nov. 13, 2012.
European Search Report of corresponding EP Application No. 12 86 1729.7 dated Nov. 11, 2014.

AIRFLOW DIRECTION CONTROL DEVICE OF AIR CONDITIONING INDOOR UNIT

CROSS-REFERENCE TO RELATED APPLICATIONS

This U.S. National stage application claims priority under 35 U.S.C. §119(a) to Japanese Patent Application No. 2011-288530, filed in Japan on Dec. 28, 2011, the entire contents of which are hereby incorporated herein by reference.

TECHNICAL FIELD

The present invention relates to an air conditioning indoor unit that utilizes the Coanda effect to guide a flow of outlet air in a predetermined direction.

BACKGROUND ART

Conventionally, there have been air conditioning indoor units that utilize the Coanda effect to guide a flow of outlet air in a predetermined direction and form an intended air direction. For example, in the air conditioner disclosed in JP-A No. 2004-101128, a horizontal louver is disposed in the neighborhood of an air outlet and in the traveling path of outlet air. In this air conditioner, all of the outlet air becomes an upward Coanda airflow along the horizontal louver because of the Coanda effect, and an air direction heading toward a ceiling in a room is formed.

SUMMARY

Technical Problem

In this connection, in order to simultaneously form plural air directions, it is conceivable to combine an air direction utilizing a Coanda airflow and an air direction not utilizing the Coanda airflow.

Therefore, it is an object of the present invention to provide an air conditioning indoor unit that can form diverse variations of air directions by simultaneously forming an air direction utilizing a Coanda airflow and an air direction not utilizing the Coanda airflow,

Solution to Problem

An air conditioning indoor unit pertaining to a first aspect of the present invention is equipped with a casing, a horizontal blade, a. Coanda blade, and a control unit. An air outlet is formed in the casing. The horizontal blade can change an up and down direction flow of outlet air blown out from the air outlet. The Coanda blade cooperates with the horizontal blade to utilize the Coanda effect to change the outlet air to a Coanda airflow along a predetermined surface. The control unit can change the postures of the Coanda blade and the horizontal blade to predetermined postures that change some of the outlet air to the Coanda airflow and do not change the rest of the outlet air to the Coanda airflow.

In the air conditioning indoor unit pertaining to the first aspect of the present invention, the postures of the Coanda blade and the horizontal blade can be changed to predetermined postures that change some of the outlet air to the Coanda airflow and do not change the rest of the outlet air to the Coanda airflow. For this reason, by changing the postures of the Coanda blade and the horizontal blade to the predetermined postures, an air direction utilizing the Coanda airflow and an air direction not utilizing the Coanda airflow can be simultaneously formed.

Because of this, diverse variations of air directions can be formed.

An air conditioning indoor unit pertaining to a second aspect of the present invention is the air conditioning indoor unit of the first aspect, wherein the Coanda blade includes a first Coanda blade and a second Coanda blade that are divided in a lengthwise direction. The control unit independently drives the first Coanda blade and the second Coanda blade. In this air conditioning indoor unit, the first Coanda blade and the second Coanda blade are independently driven, so the postures of the first Coanda blade and the second Coanda blade that are divided in the lengthwise direction can be changed to different postures. For this reason, for example, with respect to the horizontal blade that has assumed a predetermined posture, by causing the first Coanda blade to assume a posture in which the Coanda airflow along the predetermined surface is produced and causing the second Coanda blade to assume a posture in which the Coanda airflow along the predetermined surface is not produced, it can be brought about that some of the outlet air is changed to the Coanda airflow along the predetermined surface of the first Coanda blade while the rest of the outlet air is not changed to the Coanda airflow along the predetermined surface of the second Coanda blade. As a result, an air direction utilizing the Coanda airflow and an air direction not utilizing the Coanda airflow can be simultaneously formed.

An air conditioning indoor unit pertaining to a third aspect of the present invention is the air conditioning indoor unit pertaining to the first aspect or the second aspect, wherein the horizontal blade includes a first horizontal blade and a second horizontal blade that are divided in a lengthwise direction. The control unit independently drives the first horizontal blade and the second horizontal blade. In this air conditioning indoor unit, the first horizontal blade and the second horizontal blade are independently driven, so the postures of the first horizontal blade and the second horizontal blade that are divided in the lengthwise direction can be changed to different postures. For this reason, for example, with respect to the Coanda blade that has assumed a predetermined posture, by causing the first horizontal blade to assume a posture in which the Coanda airflow along the predetermined surface of the Coanda blade is produced and causing the second horizontal blade to assume a posture in which the Coanda airflow along the predetermined surface of the Coanda blade is not produced, it can be brought about that some of the outlet air becomes the Coanda airflow on the first horizontal blade side while the rest of the outlet air does not become the Coanda airflow on the second horizontal blade side. As a result, an air direction utilizing the Coanda airflow and an air direction not utilizing the Coanda airflow can be simultaneously formed.

An air conditioning indoor unit pertaining to a fourth aspect of the present invention is the air conditioning indoor unit pertaining to the first aspect, wherein the Coanda blade and the horizontal blade are not divided into two or more blades. Furthermore, combinations of the postures of the Coanda blade and the horizontal blade include a combination in which the Coanda airflow is produced on part of the Coanda blade and the Coanda airflow is not produced on other parts of the Coanda blade. In this air conditioning indoor unit, by changing the combination of the postures of the Coanda blade and the horizontal blade to the combination of postures in which the Coanda airflow is produced on part of the Coanda blade and the Coanda airflow is not produced on other parts of the Coanda blade, an air direction utilizing the Coanda airflow and an air direction not utilizing the Coanda airflow can be simultaneously formed.

An air conditioning indoor unit pertaining to a fifth aspect of the present invention is the air conditioning indoor unit of the fourth aspect and is further equipped with vertical blades that change a right and left direction flow of the outlet air. The vertical blades can assume a forward blowing posture and a lateral blowing posture. When the vertical blades assume the forward blowing posture, the outlet air is blown out in a forward direction from the air outlet. When the vertical blades assume the lateral blowing posture, the outlet air is blown out in rightward and leftward directions from the air outlet. Furthermore, the control unit changes the posture of the vertical blades to the lateral blowing posture in the case of changing the postures of the Coanda blade and the horizontal blade to the predetermined postures included in the combination in which the Coanda airflow is produced on part of the Coanda blade and the Coanda airflow is not produced on other parts of the Coanda blade. In this air conditioning indoor unit, when simultaneously forming an air direction utilizing the Coanda airflow and an air direction not utilizing the Coanda airflow, the outlet air is blown out in rightward and leftward directions from the air outlet, so the number of variations of air directions can be increased.

An air conditioning indoor unit pertaining to a sixth aspect of the present invention is the air conditioning indoor unit of the fifth aspect, wherein the control unit can execute a partial Coanda blowing mode and a normal blowing mode by changing the postures of the Coanda blade and the horizontal blade and the posture of the vertical blades. The partial Coanda blowing mode is a mode that changes some of the outlet air to the Coanda airflow and does not change the rest of the outlet air to the Coanda airflow. The normal blowing mode is a mode that changes all of the outlet air to the Coanda airflow or does not change any of the outlet air to the Coanda airflow. Moreover, a blade angle of the vertical blades assuming the lateral blowing posture with respect to the vertical blades assuming the forward blowing posture is smaller during execution of the partial Coanda blowing mode than during execution of the normal blowing mode.

The present inventor discovered that if the relative angle between the Coanda blade and the horizontal blade is not made smaller when the vertical blades assume the lateral blowing posture than when the vertical blades assume the forward blowing posture, a stable Coanda airflow cannot be produced on the entire region of the predetermined surface of the Coanda blade.

Therefore, in the air conditioning indoor unit pertaining to the sixth aspect of the present invention, by making the blade angle of the vertical blades during execution of the partial Coanda blowing mode smaller than the blade angle of the vertical blades during execution of the normal blowing mode, the concern that some of the outlet air will become the Coanda airflow during execution of the normal blowing mode can be reduced.

An air conditioning indoor unit pertaining to a seventh aspect of the present invention is the air conditioning indoor unit of any of the first aspect to the third aspect, wherein the Coanda blade includes a first Coanda blade and a second Coanda blade that are divided in a lengthwise direction. The horizontal blade includes a first horizontal blade and a second horizontal blade that are divided in the lengthwise direction. The control unit independently drives the first Coanda blade, the second Coanda blade, the first horizontal blade, and the second horizontal blade. In this air conditioning indoor unit, the first Coanda blade, the second Coanda blade, the first horizontal blade, and the second horizontal blade are independently driven, so the first Coanda blade, the second Coanda blade, the first horizontal blade, and the second horizontal blade can be caused to assume different postures. As a result, diverse variations of air directions can be formed compared to an air conditioning indoor unit in which the Coanda blade and the horizontal blade are not each divided in the lengthwise direction, for example.

An air conditioning indoor unit pertaining to an eighth aspect of the present invention is the air conditioning indoor unit of any of the first aspect to the seventh aspect, wherein a lengthwise direction dimension of the Coanda blade is shorter than a lengthwise direction dimension of the air outlet. For this reason, it can be brought about that the Coanda airflow along the predetermined surface of the Coanda blade is produced in the section having the Coanda blade while the Coanda airflow along the predetermined surface of the Coanda blade is not produced in the section not having the Coanda blade. Consequently, it can be brought about that some of the outlet air is changed to the Coanda airflow along the predetermined surface of the Coanda blade while the rest of the outlet air is not changed to the Coanda airflow along the predetermined surface of the Coanda blade, so an air direction utilizing the Coanda airflow and an air direction not utilizing the Coanda airflow can be simultaneously formed.

An air conditioning indoor unit pertaining to a ninth aspect of the present invention is the air conditioning indoor unit of any of the first aspect to the eighth aspect, wherein an air inlet for sucking in air is formed above the air outlet in the casing. Furthermore, the outlet air that has become the Coanda airflow is guided to the air inlet. For this reason, in this air conditioning indoor unit, by changing the outlet air to the Coanda airflow, a short circuit can be produced. Consequently, by bringing it about that some of the outlet air is changed to the Coanda airflow while the rest of the outlet air is not changed to the Coanda airflow, just some of the outlet air can be short-circuited. As a result, the dehumidification capability can be enhanced with the portion of the outlet air that has been short-circuited while a room can be air conditioned with the rest of the outlet air.

Advantageous Effects of Invention

In the air conditioning indoor unit pertaining to the first aspect of the present invention, by changing the postures of the Coanda blade and the horizontal blade to the predetermined postures, an air direction utilizing the Coanda airflow and an air direction not utilizing the Coanda airflow can be simultaneously formed, so diverse variations of air directions can be formed.

In the air conditioning indoor unit pertaining to the second aspect of the present invention, with respect to the horizontal blade that has assumed a predetermined posture, by causing the first Coanda blade to assume a posture in which the Coanda airflow along the predetermined surface is produced and causing the second Coanda blade to assume a posture in which the Coanda airflow along the predetermined surface is not produced, it can be brought about that some of the outlet air is changed to the Coanda airflow along the first Coanda blade while the rest of the outlet air is not changed to the Coanda airflow along the second Coanda blade, so an air direction utilizing the Coanda airflow and an air direction not utilizing the Coanda airflow can be simultaneously formed.

In the air conditioning indoor unit pertaining to the third aspect of the present invention, with respect to the Coanda blade that has assumed a predetermined posture, by causing the first horizontal blade to assume a posture in which the Coanda airflow along the predetermined surface of the Coanda blade is produced and causing the second horizontal blade to assume a posture in which the Coanda airflow along the predetermined surface of the Coanda blade is not produced, some of the outlet air becomes the Coanda airflow on the first horizontal blade side while the rest of the outlet air does not become the Coanda airflow on the second horizontal blade side, so an air direction utilizing the Coanda airflow and an air direction not utilizing the Coanda airflow can be simultaneously formed.

In the air conditioning indoor unit pertaining to the fourth aspect of the present invention, by changing the combination of the postures of the Coanda blade and the horizontal blade to the combination of postures in which the Coanda airflow is produced on part of the Coanda blade and the Coanda airflow is not produced on other parts of the Coanda blade, an air direction utilizing the Coanda airflow and an air direction not utilizing the Coanda airflow can be simultaneously formed.

In the air conditioning indoor unit pertaining to the fifth aspect of the present invention, when simultaneously forming an air direction utilizing the Coanda airflow and an air direction not utilizing the Coanda airflow, the outlet air is blown out in rightward and leftward directions from the air outlet, so the number of variations of air directions can be increased.

In the air conditioning indoor unit pertaining to the sixth aspect of the present invention, by making the blade angle of the vertical blades during execution of the partial Coanda blowing mode smaller than the blade angle of the vertical blades during execution of the normal blowing mode, the concern that some of the outlet air will become the Coanda airflow during execution of the normal blowing mode can be reduced.

In the air conditioning indoor unit pertaining to the seventh aspect of the present invention, the first Coanda blade, the second Coanda blade, the first horizontal blade, and the second horizontal blade can be caused to assume different postures, so diverse variations of air directions can be formed.

In the air conditioning indoor unit pertaining to the eighth aspect of the present invention, by making the lengthwise direction dimension of the Coanda blade shorter than the lengthwise direction dimension of the air outlet, it can be brought about that some of the outlet air is changed to the Coanda airflow while the rest of the outlet air is not changed to the Coanda airflow, and, as a result, an air direction utilizing the Coanda airflow and an air direction not utilizing the Coanda airflow can be simultaneously formed.

In the air conditioning indoor unit pertaining to the ninth aspect of the present invention, the outlet air that has become the Coanda airflow is guided to the air inlet, so by changing just some of the outlet air to the Coanda airflow, just some of the outlet air can be short-circuited, and, as a result, the dehumidification capability can be enhanced with the portion of the outlet air that has been short-circuited while a room can be air conditioned with the rest of the outlet air.

DESCRIPTION OF EMBODIMENTS

Embodiments of the present invention will be described below with reference to the drawings. The embodiments below are specific examples of the present invention and are not intended to limit the technical scope of the present invention.

<First Embodiment>

(1) Configuration of Air Conditioning Indoor Unit

Figure 1:
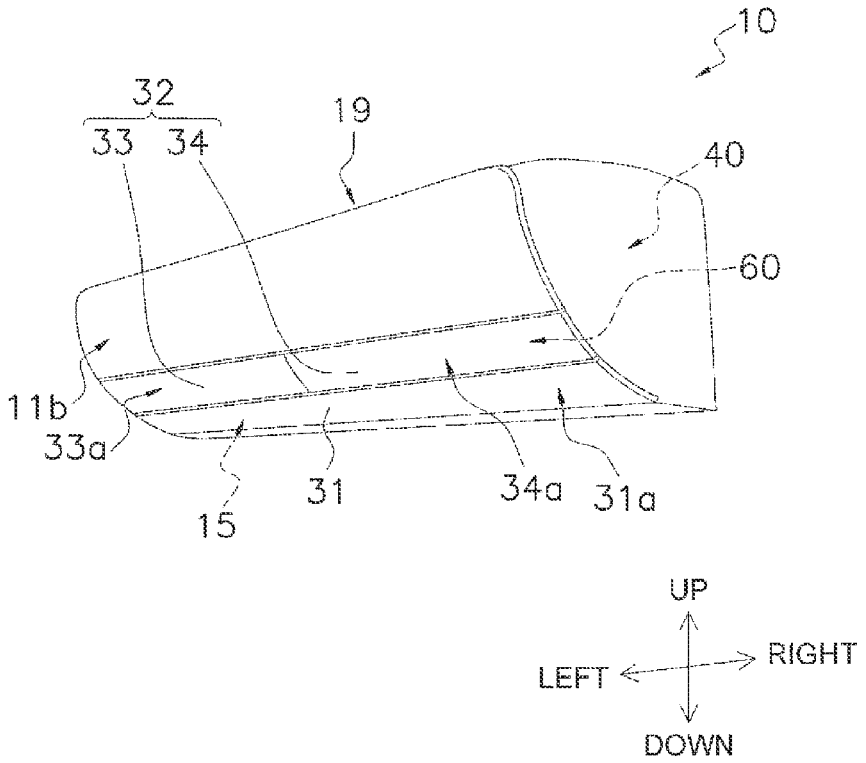
FIG. 1 is a perspective view of an air conditioning indoor unit pertaining to a first embodiment of the present invention when operation is stopped.
Figure 2:
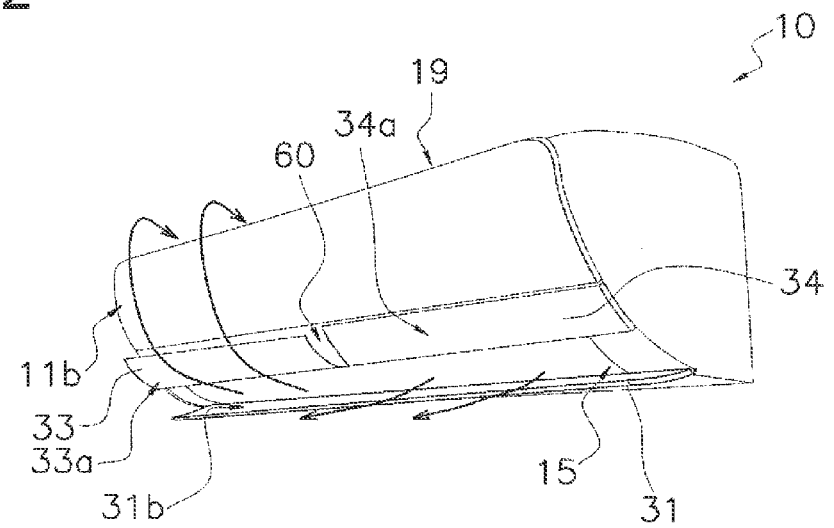
FIG. 2 is a perspective view of the air conditioning indoor unit during operation.
Figure 3:
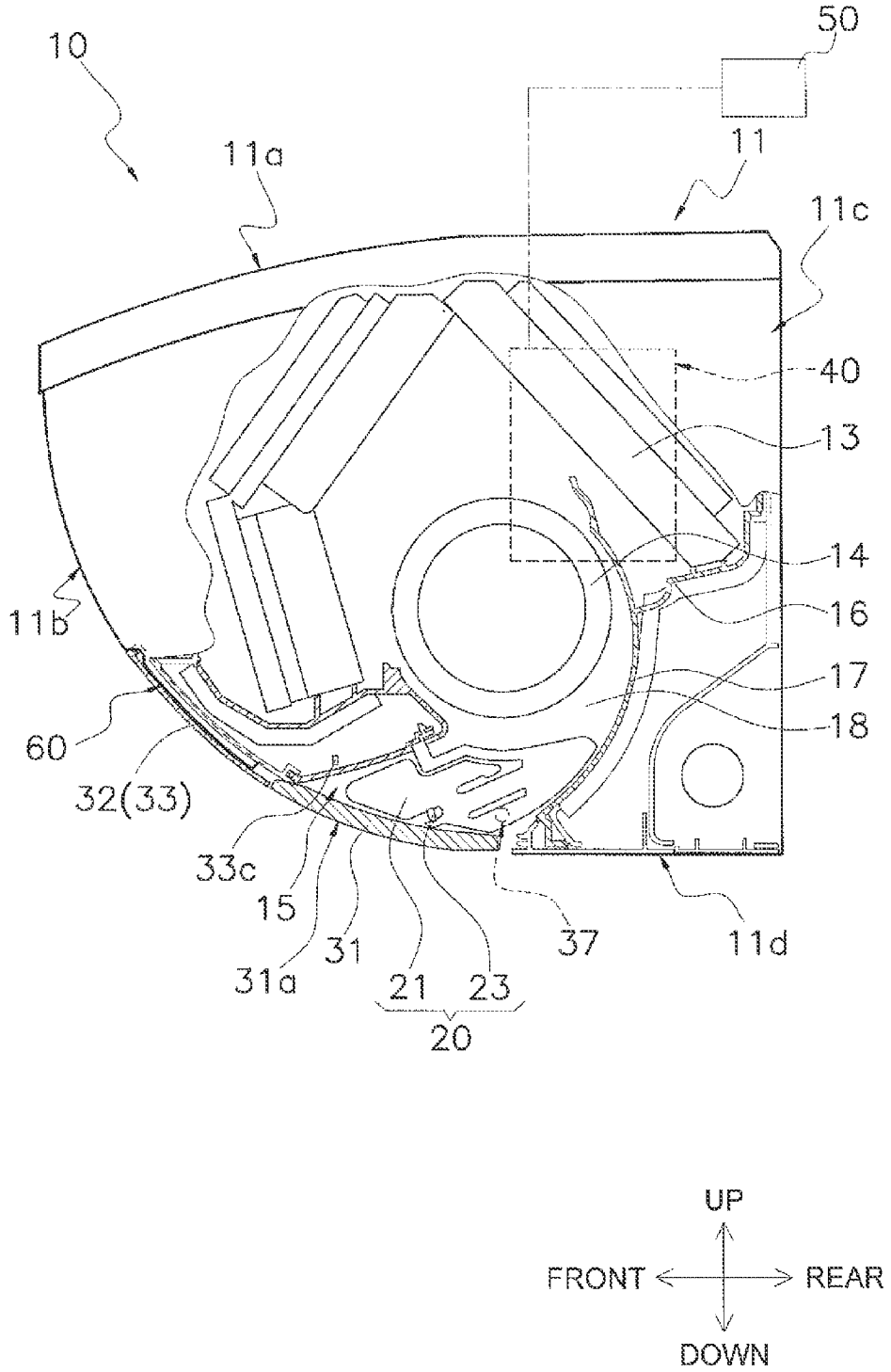
FIG. 3 is a cross-sectional view of the air conditioning indoor unit when operation is stopped.
Figure 4:
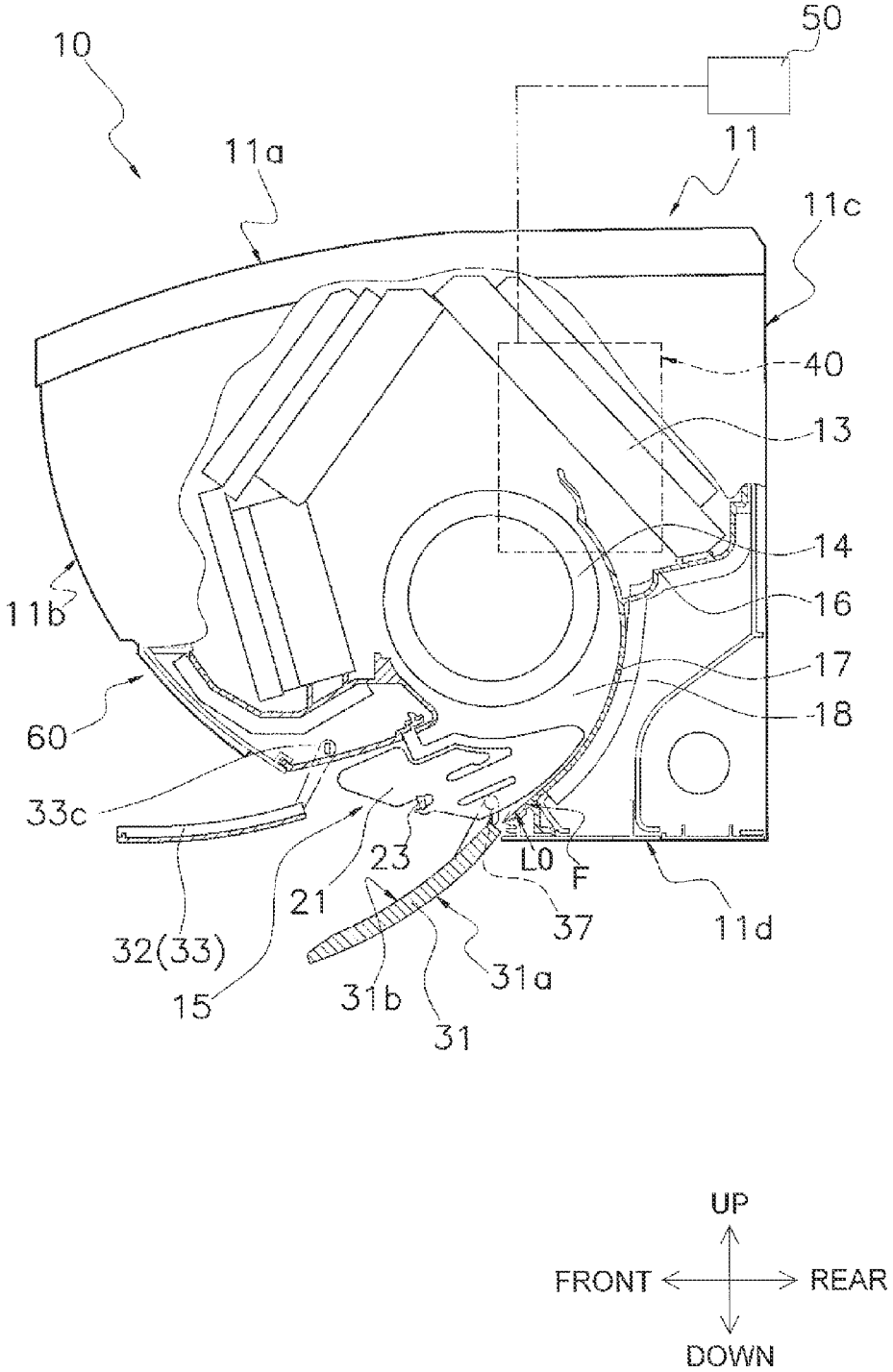
FIG. 4 is a cross-sectional view of the air conditioning indoor unit during operation.
Figure 5:
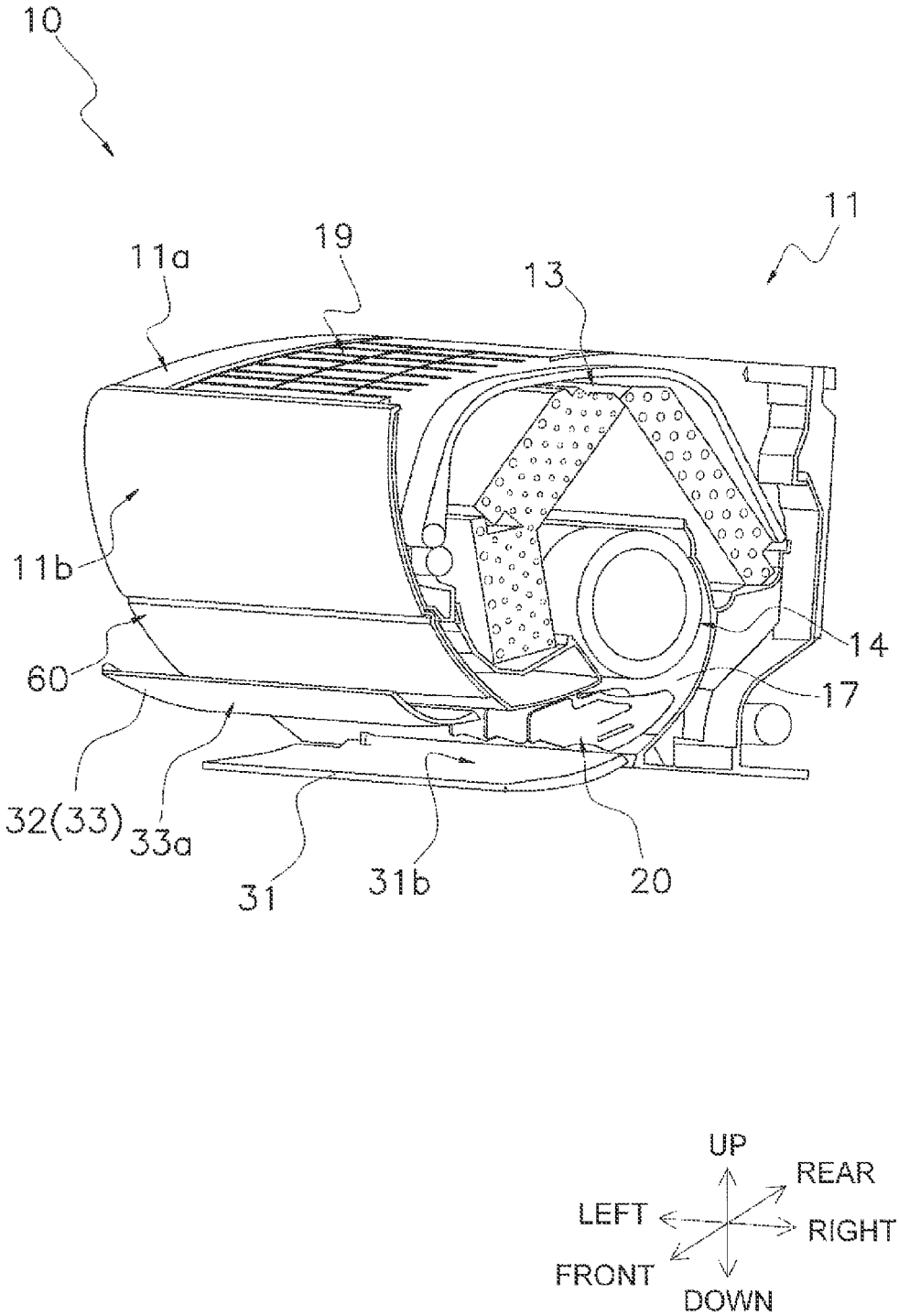
FIG. 5 is a cross-sectional view of the air conditioning indoor unit during operation.

FIG. 1 is a perspective view of an air conditioning indoor unit 10 pertaining to a first embodiment of the present invention when operation is stopped. FIG. 2 is a perspective view of the air conditioning indoor unit 10 during execution of a Coanda airflow utilization mode. FIG. 3 is a cross-sectional view of the air conditioning indoor unit 10 when operation is stopped. FIG. 4 is a cross-sectional view of the air conditioning indoor unit 10 during operation. FIG. 5 is a cross-sectional view of the air conditioning indoor unit 10 during operation as seen from an oblique direction.

The air conditioning indoor unit 10 is a wall-mounted air conditioning indoor unit attached to a wall surface in a room and is equipped with a body casing 11, an indoor heat exchanger 13, an indoor fan 14, a bottom frame 16, and a control unit 40, The body casing 11 has a top surface portion 11*a*, a front surface panel 11*b*, a back surface plate 11*c*, and a lower portion horizontal plate 11*d* and houses the indoor heat exchanger 13, the indoor fan 14, the bottom frame 16, and the control unit 40 inside.

The top surface portion 11*a* is positioned on the upper portion of the body casing 11, and an air inlet 19 is disposed in the front portion of the top surface portion 11*a*.

The front surface panel 11*b* configures the front surface portion of the air conditioning indoor unit 10 and has a flat shape not having the air inlet 19. Furthermore, the upper end of the front surface panel 11*b* is rotatably supported on the top surface portion 11*a*, so that the front surface panel 11*b* can move in a hinged manner.

The indoor heat exchanger 13 and the indoor fan 14 are attached to the bottom frame 16. The indoor heat exchanger 13 performs heat exchange with air passing through it. Furthermore, the indoor heat exchanger 13 has an inverted V shape in which both ends bend downward as seen in a side view, and the indoor fan 14 is positioned under the indoor heat exchanger 13. The indoor fan 14 is a cross flow fan, causes air taken in from the room to be applied to and pass through the indoor heat exchanger 13, and blows out the air into the room.

An air outlet 15 is disposed in the lower portion of the body casing 11. A horizontal blade 31 that changes an up and down direction flow of outlet air blown out from the air outlet 15 is rotatably attached in the air outlet 15. The horizontal blade 31 is driven by a motor (not shown in the drawings) and not only changes the up and down direction flow of the outlet air but can also open and close the air outlet 15. Furthermore, the horizontal blade 31 can assume plural postures whose angles of inclination are different.

Furthermore, a Coanda blade 32 is disposed in the neighborhood of the air outlet 15 and above the horizontal blade 31. The Coanda blade 32 is divided into plural blades (in the present embodiment, two blades), and each of the Coanda blades 32 is driven by a motor (not shown in the drawings). Furthermore, each of the Coanda blades 32 can assume plural postures whose angles of inclination are different. When operation is stopped, the Coanda blades 32 are housed in a housing portion 60 disposed in the front surface panel 11*b*.

Moreover, the air outlet 15 is connected to the inside of the body casing 11 by an outlet air flow path 18. The outlet air flow path 18 is formed from the air outlet 15 along a scroll surface 17 of the bottom frame 16.

The room air is sucked by the operation of the indoor fan 14 into the indoor fan 14 via the air inlet 19 and the indoor heat exchanger 13, travels from the indoor fan 14 through the outlet air flow path 18, and is blown out from the air outlet 15.

The control unit 40 is positioned on the right side of the indoor heat exchanger 13 and the indoor fan 14 when the body casing 11 is seen from the front surface panel 11*b* and controls the speed of the indoor fan 14 and the movement of vertical blades 20, the horizontal blade 31, and the Coanda blades 32. Furthermore, the control unit 40 independently drives the horizontal blade 31 and the Coanda blades 32.

(2) Detailed Configuration (2-1) Front Surface Panel

As shown in FIG. 3, the front surface panel 11*b* extends from the front of the upper portion of the body casing 11 toward the front edge of the lower portion horizontal plate 11*d* while describing a gentle, circular arcuate curved surface. In the lower portion of the front surface panel 11*b*, there is a region that is recessed toward the inside of the body casing 11. The recessed depth of this region is set in such a way as to match the thickness dimension of the Coanda blades 32 to thereby form the housing portion 60 in which the Coanda blades 32 are housed. The surface of the housing portion 60 is also a gentle, circular arcuate curved surface.

(2-2) Air Outlet

As shown in FIG. 3, the air outlet 15 is formed in the lower portion of the body casing 11 and is a rectangular opening whose long edges lie along the lengthwise direction of the body casing 11. The lower end portion (rear end portion) of the air outlet 15 is adjacent to the front edge of the lower portion horizontal plate 11*d*, and an imaginary plane joining the lower end portion (rear end portion) and the upper end portion (front end portion) of the air outlet 15 is inclined forward and upward.

(2-3) Scroll Surface

The scroll surface 17 is a partition wall curved in such a way as to oppose the indoor fan 14 and is part of the bottom frame 16. Furthermore, the scroll surface 17 forms the lower portion of the outlet air flow path 18, and a terminal end F of the scroll surface 17 reaches as far as the neighborhood of the peripheral edge of the air outlet 15. The air traveling through the outlet air flow path 18 proceeds along the scroll surface 17 and is sent in a direction tangential to the terminal end F of the scroll surface 17. Consequently, if the horizontal blade 31 were not in the air outlet 15, the air direction of the outlet air blown out from the air outlet 15 would be a direction generally along a tangent L0 to the terminal end F of the scroll surface 17 (see FIG. 4).

(2-4) Vertical Blades

The vertical blades 20 each have plural blade pieces 21 and a coupling rod 23 that couples together the plural blade pieces 21 (see FIG. 3 and FIG. 4). Furthermore, the vertical blades 20 are disposed further in the neighborhood of the indoor fan 14 than the horizontal blade 31 in the outlet air flow path 18.

When the coupling rods 23 reciprocate horizontally along the lengthwise direction of the air outlet 15, the plural blade pieces 21 swing right and left about a state perpendicular to that lengthwise direction. The coupling rods 23 are horizontally reciprocated by motors (not shown in the drawings).

(2-5) Horizontal Blade

The horizontal blade 31 is a single plate-like member that is long in the lengthwise direction of the air conditioning indoor unit 10, and the horizontal blade 31 has an area of an extent that it can close the air outlet 15 (see FIG. 1 and FIG. 2). An outside surface 31*a* of the horizontal blade 31 is finished to a gentle, circular arcuate curved surface that is outwardly convex in such a way as to lie on an extension of the curved surface of the front surface panel 11*b* in a state in which the horizontal blade 31 has closed the air outlet 15. Furthermore, an inside surface 31*b* of the horizontal blade 31 is also a circular arcuate curved surface substantially parallel to the outside surface 31*a*. In the present embodiment, the inside surface 31*b* of the horizontal blade 31 is a circular arcuate curved surface, but the inside surface of the horizontal blade may also be a flat surface.

The horizontal blade 31 has a rotating shaft 37 on its lower end portion (rear end portion). The rotating shaft 37 is coupled to a rotating shaft of a stepping motor (not shown in the drawings) fixed to the body casing 11 in the neighborhood of the lower end portion (rear end portion) of the air outlet 15.

When the rotating shaft 37 rotates in a counter-clockwise direction looking straight at FIG. 3, the upper end portion (front end portion) of the horizontal blade 31 moves away from the upper end portion (front end portion) side of the air outlet 15 and opens the air outlet 15. Conversely, when the rotating shaft 37 rotates in a clockwise direction looking straight at FIG. 3, the upper end portion (front end portion) of the horizontal blade 31 moves closer to the upper end portion (front end portion) side of the air outlet 15 and closes the air outlet 15.

In a state in which the horizontal blade 31 is opening the air outlet 15, the outlet air blown out from the air outlet 15 flows generally along the inside surface 31*b* of the horizontal blade 31. For this reason, in a case where the inside surface 31*b* of the horizontal blade 31 is on the upper side of the tangent L0 to the terminal end F of the scroll surface 17, the outlet air blown out generally along the direction tangential to the terminal end F of the scroll surface 17 has its air direction changed upward by the horizontal blade 31.

(2-6) Coanda Blades

As shown in FIG. 1 and FIG. 2, the Coanda blades 32 are plate-like members divided in the lengthwise direction and, in the present embodiment, are disposed adjacent to one another in the lengthwise direction (right and left direction) of the air outlet 15. Hereinafter, for convenience of description, in a case where the air conditioning indoor unit 10 is seen from the front, the Coanda blade disposed on the left side will be called a first Coanda blade 33 and the Coanda blade disposed on the right side will be called a second Coanda blade 34. Furthermore, in the present embodiment, the first Coanda blade 33 and the second Coanda blade 34 are designed in such a way that the sum total of their lengthwise direction dimensions is equal to or greater than the lengthwise direction dimension of the horizontal blade 31. Moreover, the first Coanda blade 33 and the second Coanda blade 34 are independently driven by the control unit 40.

In the present embodiment, the first Coanda blade 33 and the second Coanda blade 34 have the same configuration, so here, only the configuration of the first Coanda blade 33 will be described; regarding the configuration of the second Coanda blade 34, reference signs beginning with "34" will be assigned instead of reference signs beginning with "33" representing each part of the first Coanda blade 33, and description of each part of the second Coanda blade 34 will be omitted.

The first Coanda blade 33 is housed in the housing portion 60 in a case where air conditioning operations of the air conditioning indoor unit are stopped and in a case where the air conditioning indoor unit 10 is operating in predetermined modes described later.

Furthermore, the first Coanda blade 33 moves away from the housing portion 60 by rotating and assumes postures in which it is inclined in the front and rear direction. A rotating shaft 33*c* of the first Coanda blade 33 is disposed in the neighborhood of the lower end of the housing portion 60 and in a position inside the body casing 11 (a position above an upper wall of the outlet air flow path 18), and the lower end portion of the first Coanda blade 33 and the rotating shaft 33*c* are coupled together while maintaining a predetermined distance between them. Thus, as the rotating shaft 33*c* rotates so that the upper end portion of the first Coanda blade 33 moves away from the housing portion 60 of the front surface panel 11*b*, the height position of the lower end portion of the first Coanda blade 33 becomes lower. Furthermore, the inclination of the first Coanda blade 33 when it has rotated open is gentler than the inclination of the front surface panel 11*b*.

Furthermore, when the rotating shaft 33*c* rotates in a counter-clockwise direction looking straight at FIG. 3, both the upper end portion and the lower end portion of the first Coanda blade 33 move away from the housing portion 60 while describing a circular arc, and at this time, the shortest distance between the upper end portion of the first Coanda blade 33 and the housing portion 60 is greater than the shortest distance between the lower end portion of the first Coanda blade 33 and the housing portion 60. Additionally, when the rotating shaft 33*c* rotates in a clockwise direction looking straight at FIG. 3, the first Coanda blade 33 moves closer to the housing portion 60 and eventually is housed in the housing portion 60.

Figure 6A:
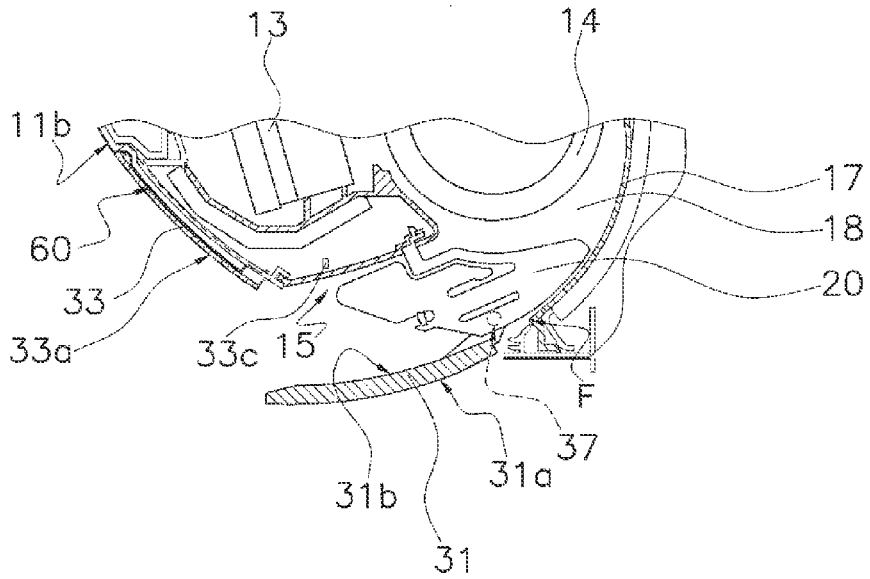
FIG. 6A is a partial cross-sectional view of the neighborhood of an air outlet during normal forward blowing of outlet air.
Figure 6B:
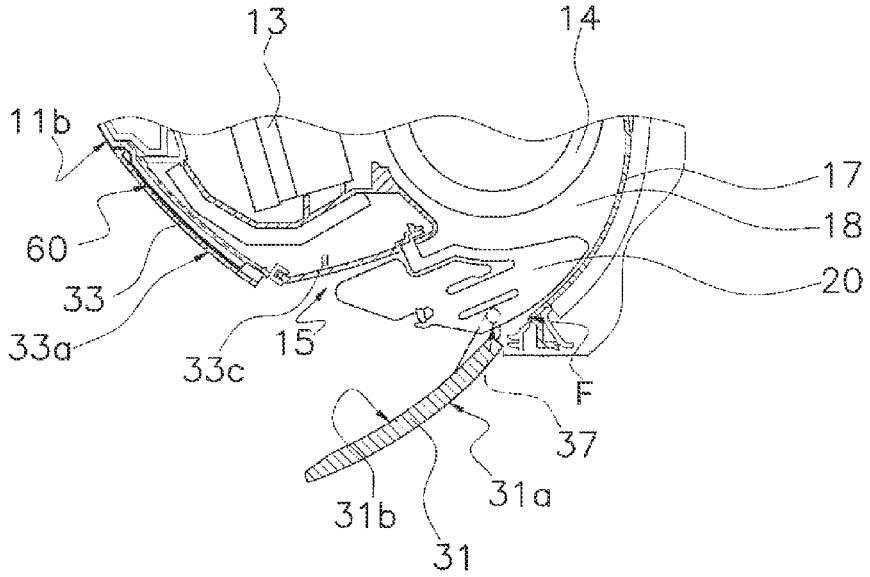
FIG. 6B is a partial cross-sectional view of the neighborhood of the air outlet during normal forward and downward blowing of the outlet air.
Figure 6C:
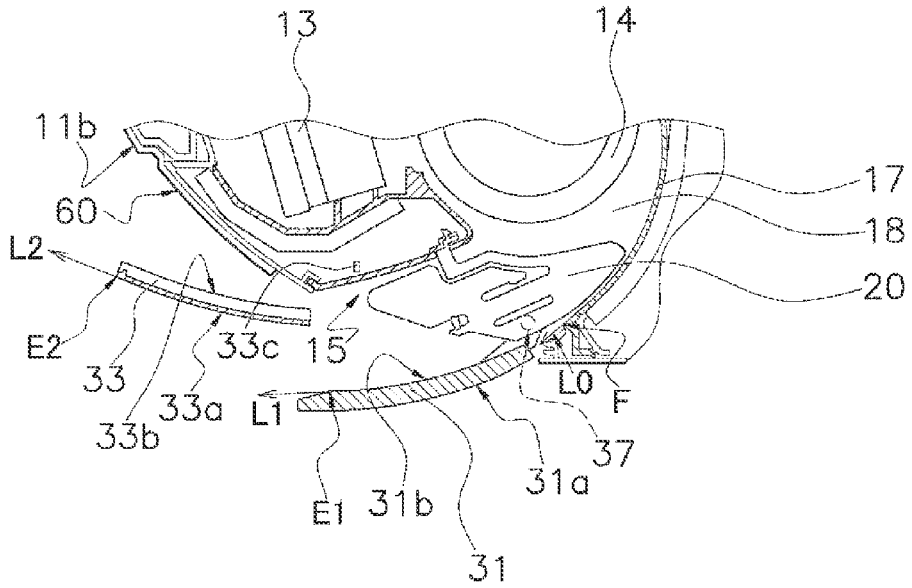
FIG. 6C is a partial cross-sectional view of the neighborhood of the air outlet during Coanda airflow ceiling blowing of the outlet air.
Figure 6D:
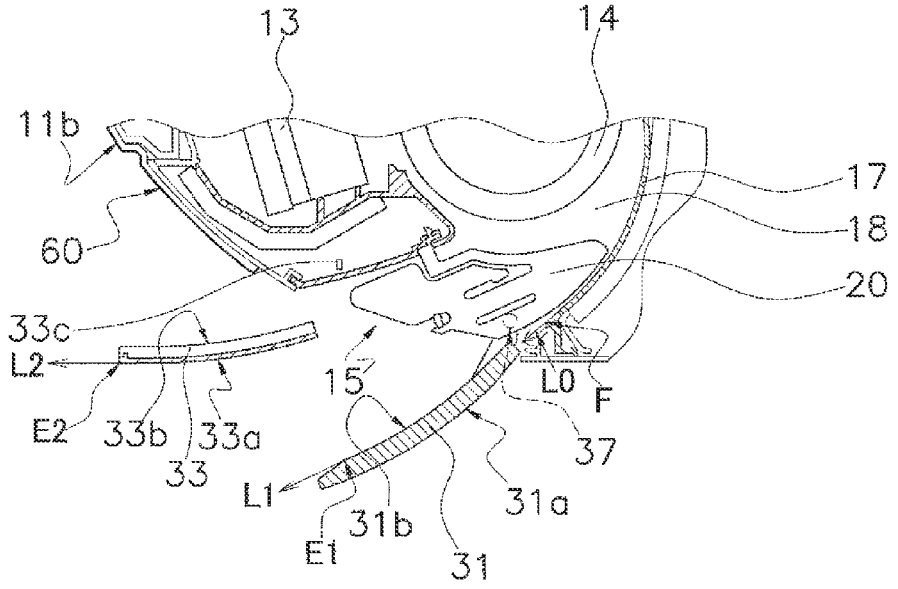
FIG. 6D is a partial cross-sectional view of the neighborhood of the air outlet during Coanda airflow forward blowing of the outlet air.
Figure 6E:
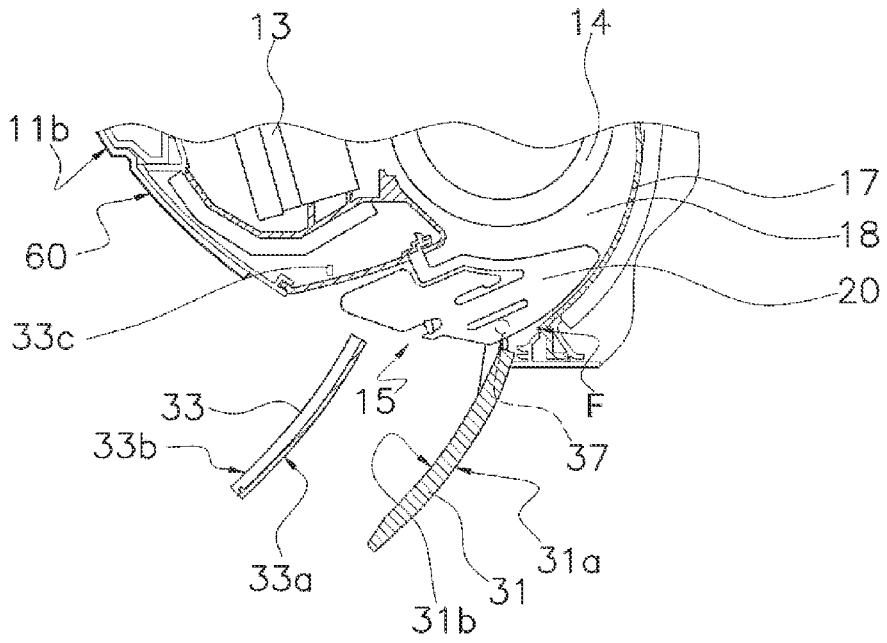
FIG. 6E is a partial cross-sectional view of the neighborhood of the air outlet during downward blowing of the outlet air.
Figure 6F:
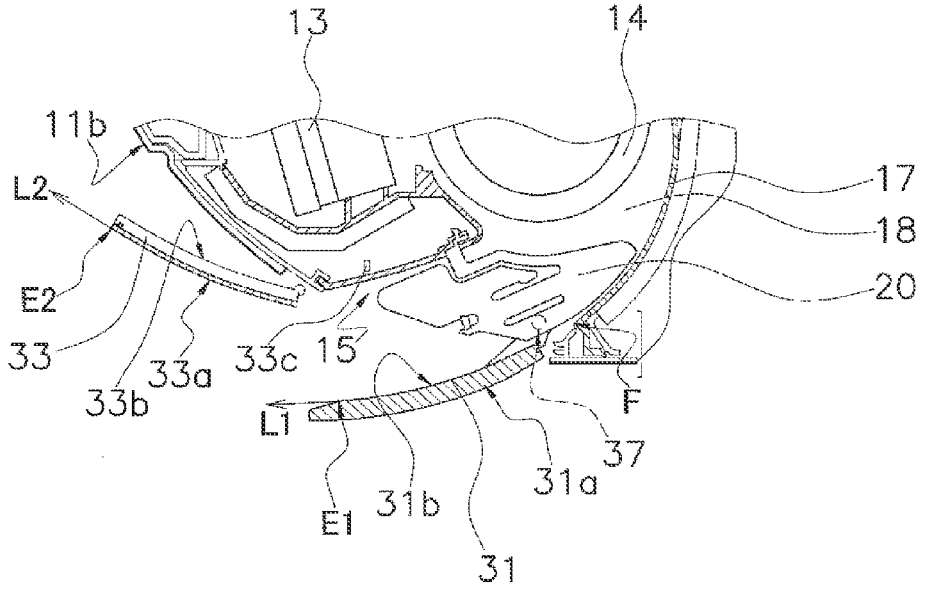
FIG. 6F is a partial cross-sectional view of the neighborhood of the air outlet during dehumidification function enhancement blowing of the outlet air.

The postures of the first Coanda blade 33 include, for example, a first posture in which the first Coanda blade 33 is housed in the housing portion 60 as shown in FIG. 6A and FIG. 6B, a second posture in which the first Coanda blade 33 rotates to become inclined forward and upward as shown in FIG. 6C, a third posture in which the first Coanda blade 33 further rotates from the second posture to become substantially horizontal as shown in FIG. 6D, a fourth posture in which the first Coanda blade 33 further rotates from the third posture to become inclined forward and downward as shown in FIG. 6E, and a fifth posture whose angle of inclination is, as shown in FIG. 6F, smaller than it is in the first posture and larger than it is in the second posture.

Furthermore, an outside surface 33*a* of the first Coanda blade 33 is finished to a gentle, circular arcuate curved surface that is outwardly convex in such a way as to lie on an extension of the gentle, circular arcuate curved surface of the front surface panel 11*b* in a state in which the first Coanda blade 33 is housed in the housing portion 60. Furthermore, an inside surface 33*b* of the first Coanda blade 33 is finished to a circular arcuate curved surface that follows the surface of the housing portion 60.

In the present embodiment, the outside surfaces 33*a* and 34*a* of the first Coanda blade 33 and the second Coanda blade 34 are circular arcuate curved surfaces, but the outside surfaces of the first Coanda blade and the second Coanda blade may also be flat surfaces.

(3) Directional Control of Outlet Air

The air conditioning indoor unit 10 has, as means of controlling the direction of the outlet air, a normal blowing mode in which only the horizontal blade 31 is rotated to adjust the direction of the outlet air, a Coanda airflow utilization mode in which the horizontal blade 31 and at least one of the first Coanda blade 33 and the second Coanda blade 34 are rotated to utilize the Coanda effect to change at least sonic of the outlet air to a Coanda airflow along the outside surface 33*a* of the first Coanda blade 33 and/or the outside surface 34*a* of the second Coanda blade 34, and a downward blowing mode in which the front ends of the horizontal blade 31, the first Coanda blade 33, and the second Coanda blade 34 are pointed forward and downward to guide the outlet air downward.

Furthermore, the postures of the horizontal blade 31, the first Coanda blade 33, and the second Coanda blade 34 change in each mode with each direction in which the air is blown out. The postures of the horizontal blade 31, the first Coanda blade 33, and the second Coanda blade 34 employed in each mode are preset and stored in a storage unit (not shown in the drawings) that the control unit 40 has.

The user can select the blowing direction via a remote controller 50 or the like. Furthermore, it is also possible for the changing of the modes and the blowing direction to be controlled in such a way that they are automatically changed.

(3-1) Normal Blowing Mode

The normal blowing mode is a mode in which only the horizontal blade 31 is rotated to adjust the direction of the outlet air. As examples of the normal blowing mode, "normal forward blowing" and "normal forward and downward blowing" will be described below.

(3-1-1) Normal Forward Blowing

When the user has selected the "normal forward blowing," the control unit 40 rotates the horizontal blade 31 to a position in which the inside surface 31*b* of the horizontal blade 31 becomes substantially horizontal (see FIG. 6A). This results in an air direction in which the outlet air is blown forward along the inside surface 31*b* of the horizontal blade 31.

(3-1-2) Normal Forward and Downward Blowing

When the user wants to change the blowing direction so that it is more downward than in the "normal forward blowing," the user selects the "normal forward and downward blowing." At this time, the control unit 40 rotates the horizontal blade 31 until the front part of the inside surface 31*b* of the horizontal blade 31 becomes lower than horizontal (see FIG. 6B). As a result, the outlet air takes a forward and downward air direction along the inside surface 31*b* of the horizontal blade Si.

(3-2) Coanda Airflow Utilization Mode

Coanda (effect) is a phenomenon where, if there is a wall near a flow of gas or liquid, the gas or liquid tends to flow in a direction along the wall surface even if the direction of the flow and the direction of the wall are different (*Hösoku no jiten*, Asakura Publishing Co., Ltd.). Additionally, in order to produce the Coanda effect on the outside surfaces 33*a* and 34*a* of the first Coanda blade 33 and the second Coanda blade 34, it is necessary for the inclination of the direction of the outlet air changed by the inside surface 31*b* of the horizontal blade 31 to become closer to the posture (inclination) of the first Coanda blade 33 and the second Coanda blade 34, and if both are too far away from one another, the Coanda effect will not be produced on the first Coanda blade 33 and the second Coanda blade 34.

For this reason, in order to change the outlet air to a Coanda airflow along the outside surfaces 33*a* and 34*a* of the first Coanda blade 33 and the second Coanda blade 34, it is necessary to set both the open angle formed by the first Coanda blade 33 and the horizontal blade 31 and the open angle formed by the second Coanda blade 34 and the horizontal blade 31 to an angle equal to or less than a predetermined angle, that is, to set both the relative angle between the first Coanda blade 33 and the horizontal blade 31 and the relative angle between the second Coanda blade 34 and the horizontal blade 31 to an angle equal to or less than the predetermined angle.

Consequently, by setting both the relative angle between the first Coanda blade 33 and the horizontal blade 31 and the relative angle between the second Coanda blade 34 and the horizontal blade 31 to an angle equal to or less than the predetermined angle, all of the outlet air can be changed to a Coanda airflow along the outside surfaces 33*a* and 34*a* of the first Coanda blade 33 and the second Coanda blade 34. As a result, the air direction of all of the outlet air is changed by the horizontal blade 31 and is thereafter further changed by the Coanda effect, so just an air direction utilizing the Coanda airflow can be formed.

On the other hand, by setting either one of the relative angle between the first Coanda blade 33 and the horizontal blade 31 and the relative angle between the second Coanda blade 34 and the horizontal blade 31 to an angle equal to or less than the predetermined angle and setting the other to an angle greater than the predetermined angle, it can be brought about that some of the outlet air is changed to a Coanda airflow along the outside surface of the first Coanda blade 33 or the second Coanda blade 34 while the rest of the outlet air is not changed to a Coanda airflow. As a result, the air direction of the outlet air is changed by the horizontal blade 31, and thereafter some of the outlet air has its air direction further changed by the Coanda effect while the rest of the outlet air has its air direction maintained as is because it is not changed by the Coanda effect. Because of this, an air direction utilizing a Coanda airflow and an air direction not utilizing a Coanda airflow (the air direction changed by the horizontal blade 31) can be simultaneously formed.

As examples of the Coanda airflow utilization mode, "Coanda airflow ceiling blowing" and "Coanda airflow forward blowing," which change all of the outlet air to a Coanda airflow, and "partial ceiling blowing" and "dehumidification capability enhancement blowing," which change some of the outlet air to a Coanda airflow and do not change the rest of the outlet air to a Coanda airflow, will be described below.

In the present embodiment, in the "Coanda airflow ceiling blowing" and the "Coanda airflow forward blowing" that change all of the outlet air to a Coanda airflow, the first Coanda blade 33 and the second Coanda blade 34 assume the same posture. Furthermore, in the "Coanda airflow ceiling blowing" and the "Coanda airflow forward blowing" of the present embodiment, the postures of the first Coanda blade 33, the second Coanda blade 34, and the horizontal blade 31 are set in such a way that the relative angle between the first Coanda blade 33 and the horizontal blade 31 and the relative angle between the second Coanda blade 34 and the horizontal blade 31 both become an angle equal to or less than the predetermined angle.

Moreover, in the "partial ceiling blowing" and the "dehumidification capability enhancement blowing" of the present embodiment," the postures of the first Coanda blade 33, the second Coanda blade 34, and the horizontal blade 31 are set in such a way that the relative angle between the first Coanda blade 33 and the horizontal blade 31 becomes an angle equal to or less than the predetermined angle and the relative angle between the second Coanda blade 34 and the horizontal blade 31 becomes an angle greater than the predetermined angle. Furthermore, the posture of the first Coanda blade 33 employed in the "dehumidification capability enhancement blowing" of the present embodiment is set in such a way that a Coanda airflow along the outside surface 33*a* of the first Coanda blade 33 is produced to thereby create a short circuit in which the outlet air is guided to the neighborhood of the air inlet 19 and is sucked in from the air inlet 19.

(3-2-1) Coanda Airflow Ceiling Blowing

When the "Coanda airflow ceiling blowing" has been selected by the user, the control unit 40 rotates the horizontal blade 31 until the inside surface 31*b* of the horizontal blade 31 becomes substantially horizontal. Next, the control unit 40 rotates the first Coanda blade 33 and the second Coanda blade 34 until the outside surfaces 33*a* and 34*a* of the first Coanda blade 33 and the second Coanda blade 34 point forward and upward to cause the first Coanda blade 33 and the second Coanda blade 34 to assume the second posture. Because of this, the outlet air adjusted by the horizontal blade 31 so as to be blown horizontally becomes an airflow attached to the outside surfaces 33*a* and 34*a* of the first Coanda blade 33 and the second Coanda blade 34 because of the Coanda effect and changes to a Coanda airflow along the outside surfaces 33*a* and 34*a*.

Consequently, as shown in FIG. 6C, even when the direction of a tangent L1 to a front end E1 of the horizontal blade 31 is such as to result in forward blowing, the direction of a tangent L2 to front ends E2 of the first Coanda blade 33 and the second Coanda blade 34 is such as to result in forward and upward blowing, so the outlet air is blown out in the direction of the tangent L2 to the front ends E2 of the outside surfaces 33*a* and 34*a* of the first Coanda blade 33 and the second Coanda blade 34—that is, in the direction of the ceiling—because of the Coanda effect.

In this way, in the Coanda airflow ceiling blowing, the upper end portions of the first Coanda blade 33 and the second Coanda blade 34 move away from the front surface panel 11*b* so that the inclination of the first Coanda blade 33 and the second Coanda blade 34 becomes gentle, so the outlet air becomes susceptible to the Coanda effect in front of the front surface panel 11*b*. This results in an upward air direction because of the Coanda effect even when the outlet air whose air direction has been adjusted by the horizontal blade 31 is blown forward.

(3-2-2) Coanda Airflow Forward Blowing

When the "Coanda airflow forward blowing" has been selected by the user, the control unit 40 rotates the horizontal blade 31 until the front part of the inside surface 31*b* of the horizontal blade 31 becomes lower than horizontal. Next, the control unit 40 rotates the first Coanda blade 33 and the second Coanda blade 34 to a position in which the outside surfaces 33*a* and 34*a* of the first Coanda blade 33 and the second Coanda blade 34 become substantially horizontal to cause the first Coanda blade 33 and the second Coanda blade 34 to assume the third posture. Because of this, the outlet air adjusted by the horizontal blade 31 so as to be blown forward and downward becomes an airflow attached to the outside surfaces 33*a* and 34*a* of the first Coanda blade 33 and the second Coanda blade 34 because of the Coanda effect and changes to a Coanda airflow along the outside surfaces 33*a* and 34*a*.

Consequently, as shown in FIG. 61), even when the direction of the tangent L1 to the front end. E1 of the horizontal blade 31 is such as to result in forward and downward blowing, the direction of the tangent L2 to the front ends E2 of the first Coanda blade 33 and the second Coanda blade 34 is horizontal, so the outlet air is blown out in the direction of the tangent L2 to the front ends E2 of the outside surfaces 33*a* and 34*a* of the first Coanda blade 33 and the second Coanda blade 34—that is, in the horizontal direction—because of the Coanda effect.

In this way, in the Coanda airflow forward blowing, the upper end portions of the first Coanda blade 33 and the second Coanda blade 34 move away from the front surface panel 11*b* so that the inclination of the first Coanda blade 33 and the second Coanda blade 34 becomes gentle, and the outlet air becomes susceptible to the Coanda effect in front of the front surface panel 11*b*. This results in horizontally blown air because of the Coanda effect even when the outlet air whose air direction has been adjusted by the horizontal blade 31 is blown forward and downward.

(3-2-3) Partial Ceiling Blowing

When the "partial ceiling blowing" has been selected by the user, the control unit 40 rotates the horizontal blade 31 until the inside surface 31*b* of the horizontal blade 31 becomes substantially horizontal. Next, the control unit 40 rotates the first Coanda blade 33 to cause the first Coanda blade 33 to assume the second posture. At this time, the second Coanda blade 34 is not rotated and assumes the first posture in which it is housed in the housing portion 60. Because of this, some of the outlet air adjusted by the horizontal blade 31 so as to be blown horizontally becomes an airflow attached to the outside surface 33*a* of the first Coanda blade 33 because of the Coanda effect and changes to a Coanda airflow along the outside surface 33*a*. Meanwhile, the rest of the outlet air adjusted by the horizontal blade 31 so as to be blown horizontally cannot become an airflow attached to the outside surface 34*a* of the second Coanda blade 34, so it does not change to a Coanda airflow along the outside surface 34*a*.

Consequently, even when the direction of the tangent L1 to the front end E1 of the horizontal blade 31 is such as to result in forward blowing, the direction of the tangent L2 to the front end E2 of the first Coanda blade 33 is such as to result in forward and upward blowing, so some of the outlet air is blown out in the direction of the tangent L2 to the front end E2 of the outside surface 33*a* of the first Coanda blade 33—that is, in the direction of the ceiling—because of the Coanda effect. Meanwhile, the rest of the outlet air does not become a Coanda airflow along the outside surface 34*a* of the second Coanda blade 34, so it is blown out in the direction of the tangent L1 to the front end E1 of the horizontal blade 31, that is, forward along the inside surface 31*b* of the horizontal blade 31. In this way, in the partial ceiling blowing, an air direction heading in the direction of the ceiling and an air direction heading forward can be simultaneously formed.

(3-2-4) Dehumidification Capability Enhancement Blowing

Figure 7:
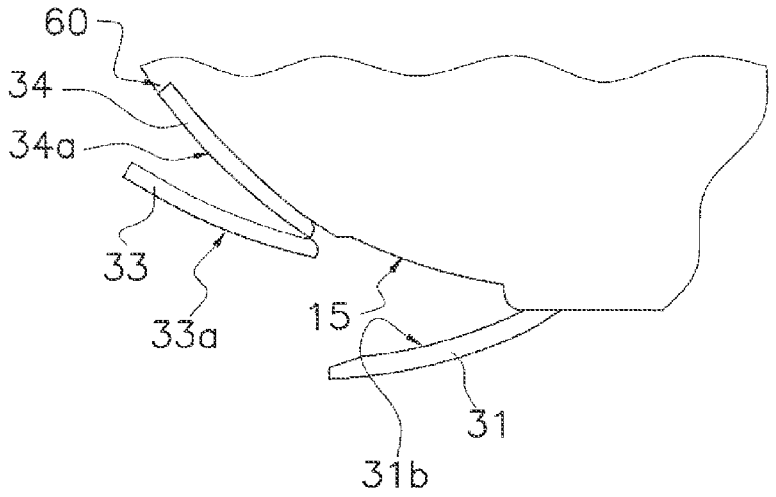
FIG. 7 is a side view of the air conditioning indoor unit and shows a section in the neighborhood of the air outlet during the dehumidification function enhancement blowing of the outlet air.

FIG. 7 is a side view of a section in the neighborhood of the air outlet 15 of the air conditioning indoor unit 10 in which the dehumidification capability enhancement blowing is being executed.

When the "dehumidification capability enhancement blowing" has been selected by the user, the control unit 40 rotates the horizontal blade 31 until the inside surface 31*b* of the horizontal blade 31 becomes substantially horizontal. Next, the control unit 40 rotates the first Coanda blade 33 to cause the first Coanda blade 33 to assume the fifth posture. At this time, the second Coanda blade 34 is not rotated and assumes the first posture in which it is housed in the housing portion. Because of this, some of the air adjusted by the horizontal blade 31 so as to be blown horizontally becomes an airflow attached to the outside surface 33*a* of the first Coanda blade 33 because of the Coanda effect and changes to a Coanda airflow along the outside surface 33*a*. Meanwhile, the rest of the outlet air adjusted by the horizontal blade 31 so as to be blown horizontally cannot become an airflow attached to the outside surface 34*a* of the second Coanda blade 34, so it does not change to a Coanda airflow along the outside surface 34*a*.

Consequently, even when the direction of the tangent L1 to the front end E1 of the horizontal blade 31 is such as to result in forward blowing, the direction of the tangent L2 to the front end E2 of the first Coanda blade 33 is such as to result in upward blowing, so some of the outlet air is blown out in the direction of the tangent L2 to the front end E2 of the outside surface 33*a* of the first Coanda blade 33—that is, upward—because of the Coanda effect (see FIG. 6F). Additionally, the portion of the outlet air blown out upward because of the Coanda effect is guided to the neighborhood of the air inlet 19 located higher than the air outlet 15 and is thereby sucked into the body casing 11 from the air inlet 19. Meanwhile, the rest of the outlet air does not become a Coanda airflow along the outside surface 34*a* of the second Coanda blade 34, so it is blown out in the direction of the tangent L1 to the front end E1 of the horizontal blade 31, that is, forward along the inside surface 31*b* of the horizontal blade 31.

In this way, in the dehumidification capability enhancement blowing, an air direction heading toward the neighborhood of the air inlet 19 and an air direction heading forward can be simultaneously formed. For this reason, some of the outlet air can be short-circuited to enhance the dehumidification capability while the room air can be circulated by the outlet air blown out forward.

(3-3) Downward Blowing Mode

When the "downward blowing" has been selected by the user, the control unit 40 rotates the horizontal blade 31 until the inside surface 31*b* of the horizontal blade 31 points downward (see FIG. 6E). Next, the control unit 40 rotates the first Coanda blade 33 and the second Coanda blade 34 until the outside surfaces 33*a* and 34*a* of the first Coanda blade 33 and the second Coanda blade 34 point downward (see FIG. 6E). As a result, the outlet air passes between the horizontal blade 31 and the first Coanda blade 33 and the second Coanda blade 34 and is blown out downward.

In particular, even when the horizontal blade 31 is positioned in an angle that points more downward than the tangent L0 to the terminal end F of the scroll surface 17, a downward airflow can be produced by applying to the outside surfaces 33*a* and 34*a* of the first Coanda blade 33 and the second Coanda blade 34 as a result of the control unit 40 executing the downward blowing mode.

(4) Characteristics (4-1)

In the present embodiment, the first Coanda blade 33 and the second Coanda blade 34 cooperate with the horizontal blade 31 to utilize the Coanda effect to change the outlet air to a Coanda airflow along the outside surfaces 33*a* and 34*a*. Furthermore, in the "partial ceiling blowing" and the "dehumidification capability enhancement blowing" in the Coanda airflow utilization mode, the control unit 40 can change the postures of the first Coanda blade 33, the second Coanda blade 34, and the horizontal blade 31 to predetermined postures that change some of the outlet air to a Coanda airflow and do not change the rest of the outlet air to a Coanda airflow. As a result, an air direction utilizing a Coanda airflow and an air direction not utilizing a Coanda airflow can be simultaneously formed.

Because of this, in the Coanda airflow utilization mode, the number of variations of air directions can be increased compared to an air conditioning indoor unit in which only an air direction that changes all of the outlet air to a Coanda airflow is formed.

Furthermore, by executing the "partial ceiling blowing," the portion of the outlet air that has become the Coanda airflow can be circulated in the room to evenly air condition the entire room while imparting a moderate draft sensation to the user.

4-2

In the present embodiment, the first Coanda blade 33 and the second Coanda blade 34 are independently driven, so the first Coanda blade 33 and the second Coanda blade 34 that are adjacent to one another in the lengthwise direction of the air outlet 15 (the width direction of the outlet air) and divided in the lengthwise direction can be caused to assume different postures. For this reason, the relative angle between the first Coanda blade 33 and the horizontal blade 31 and the relative angle between the second Coanda blade 34 and the horizontal blade 31 can be changed to different angles. Consequently, by setting the postures of the horizontal blade 31, the first Coanda blade 33, and the second Coanda blade 34 in such a way that the relative angle between the horizontal blade 31 and the first Coanda blade 33 becomes an angle equal to or less than the predetermined angle and at which the Coanda airflow is produced and in such a way that the relative angle between the horizontal blade 31 and the second Coanda blade 34 becomes an angle greater than the predetermined angle and at which the Coanda airflow is not produced, it can be brought about that some of the outlet air is changed to a Coanda airflow while the rest of the outlet air is not changed to a Coanda airflow.

Additionally, in the present embodiment, in the "partial ceiling blowing," by causing the horizontal blade 31 to assume a posture in which the tangent L1 to the front end E1 of the inside surface 31*b* of the horizontal blade 31 becomes substantially horizontal, causing the first Coanda blade 33 to assume the second posture so that the relative angle between the first Coanda blade 33 and the horizontal blade 31 becomes an angle equal to or less than the predetermined angle, and causing the second Coanda blade 34 to assume the first posture so that the relative angle between the second Coanda blade 34 and the horizontal blade 31 becomes an angle greater than the predetermined angle, it can be brought about that some of the outlet air adjusted by the horizontal blade 31 so as to be blown horizontally is changed to a Coanda airflow along the outside surface 33*a* of the first Coanda blade 33 while the rest of the outlet air is not changed to a Coanda airflow. As a result, an air direction utilizing a Coanda airflow and heading in the direction of the ceiling and an air direction not utilizing a Coanda airflow and heading forward can be simultaneously formed.

Furthermore, in the "dehumidification capability enhancement blowing," by causing the horizontal blade 31 to assume a posture in which the tangent L1 to the front end E1 of the inside surface 31*b* of the horizontal blade 31 becomes substantially horizontal, causing the first Coanda blade 33 to assume the fifth posture so that the relative angle between the first Coanda blade 33 and the horizontal blade 31 becomes an angle equal to or less than the predetermined angle, and causing the second Coanda blade 34 to assume the first posture so that the relative angle between the second Coanda blade 34 and the horizontal blade 31 becomes an angle greater than the predetermined angle, it can be brought about that some of the outlet air adjusted by the horizontal blade 33 so as to be blown horizontally is changed to a Coanda airflow along the outside surface 33*a* of the first Coanda blade 33 while the rest of the outlet air is not changed to a Coanda airflow. As a result, an air direction utilizing a Coanda airflow and heading upward and an air direction not utilizing a Coanda airflow and heading forward can be simultaneously formed.

4-3

In the present embodiment, in the "dehumidification capability enhancement blowing," the portion of the outlet air that has become the Coanda airflow along the outside surface 33*a* of the first Coanda blade 33 is guided to the neighborhood of the air inlet 19 and is thereby sucked in from the air inlet 19. Meanwhile, the rest of the outlet air that has not become a Coanda airflow along the outside surface 34*a* of the second Coanda blade 34 is blown out forward along the inside surface 31*b* of the horizontal blade 31. In this way, in the "dehumidification capability enhancement blowing," just some of the outlet air can be short-circuited, so the dehumidification capability can be enhanced with the portion of the outlet air that has been short-circuited while the room can be air conditioned with the rest of the outlet air.

(5) Example Modifications (5-1) Example Modification 1A

In the above embodiment, in the "partial ceiling blowing" and the "dehumidification capability enhancement blowing" in the Coanda airflow utilization mode, the first Coanda blade 33 rotates to assume a predetermined posture and the second Coanda blade 34 does not rotate and assumes the first posture, but the present invention is not limited to this as long as some of the outlet air becomes a Coanda airflow and the rest of the outlet air does not become a Coanda airflow.

For example, it is also alright if the second Coanda blade 34 rotates to assume a predetermined posture and the first Coanda blade 33 does not rotate and assumes the first posture. Furthermore, it is also alright for the user to use a remote controller or the like to set which of the first Coanda blade 33 and the second Coanda blade 34 is to rotate.

(5-2) Example Modification 1B

In the above embodiment, in each mode, the first Coanda blade 33, the second Coanda blade 34, and the horizontal blade 31 are each fixed in predetermined postures. In addition to this, in each mode, the first Coanda blade 33. the second Coanda blade 34, and/or the horizontal blade 31 may also be caused to swing in predetermined ranges so that the air directions in each mode are formed. In this way, by causing the first Coanda blade 33, the second Coanda blade 34, and/or the horizontal blade 31 to swing, the number of variations of air directions can be increased compared to the above embodiment.

Furthermore, in the "Coanda airflow ceiling blowing" and the "Coanda airflow forward blowing" of the above embodiment, the first Coanda blade 33 and the second Coanda blade 34 assume the same posture. In addition to this, in the "Coanda airflow ceiling blowing" and the "Coanda airflow forward blowing," the first Coanda blade 33 and the second Coanda blade may also be fixed in different postures as long as the relative angle between the first Coanda blade 33 and the horizontal blade 31 becomes an angle equal to or less than the predetermined angle and the relative angle between the second Coanda blade 34 and the horizontal blade 31 becomes an angle equal to or less than the predetermined angle. In this way, in the "Coanda airflow ceiling blowing" and the "Coanda airflow forward blowing," by fixing the first Coanda blade 33 and the second Coanda blade in different postures, the number of variations of air directions can be further increased compared to the above embodiment.

(5-3) Example Modification 1C

In the above embodiment, the Coanda blade 32 is divided into two blades. Instead of this, the Coanda blade may also be divided into three or more blades in the lengthwise direction. As long as the plurally divided Coanda blades can be independently driven, the number of variations of air directions can be further increased compared to the above embodiment.

(5-4) Example Modification 1D

In the above embodiment, in the "dehumidification capability enhancement blowing," some of the outlet air is changed to a Coanda airflow along the outside surface 33*a* of the first Coanda blade 33 and short-circuited while the rest of the outlet air is blown out in a direction (forward) along the inside surface 31*b* of the horizontal blade 31 without being changed to a Coanda airflow along the outside surface 34*a* of the second Coanda blade 34.

Instead of this, as long as some of the outlet air short-circuits, in the "dehumidification capability enhancement blowing" the postures of the horizontal blade 31, the first Coanda blade 33, and the second Coanda blade 34 may also be set in such a way that a Coanda airflow along the outside surfaces 33*a* and 34*a* of the first Coanda blade 33 and the second Coanda blade 34 is produced.

Figure 8:
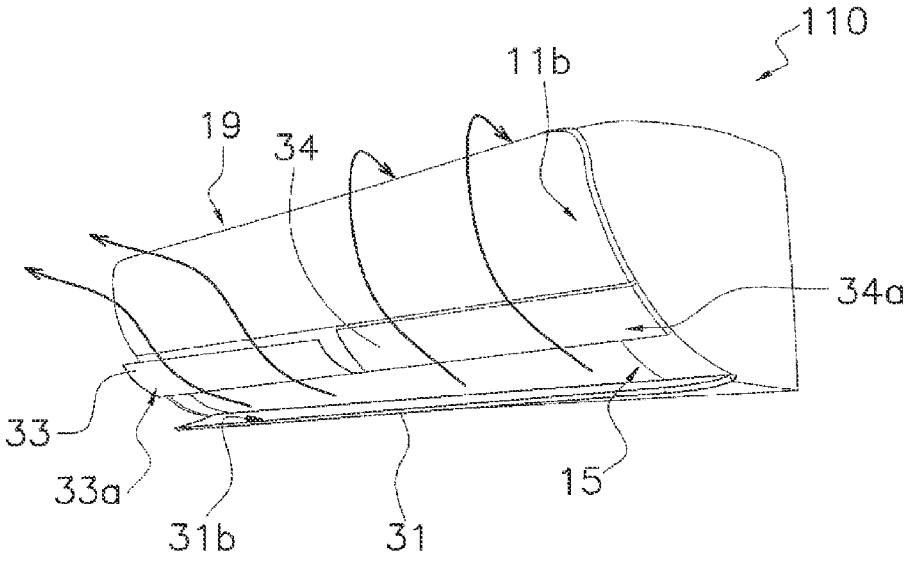
FIG. 8 is a perspective view of an air conditioning indoor unit pertaining to example modification 1D during operation.

Furthermore, whether or not a Coanda airflow along the outside surfaces of the Coanda blades is produced is mainly determined by the relative angles between the horizontal blade and the Coanda blades, so the air conditioning indoor unit can also be designed in such a way that, for example, by causing the horizontal blade to assume a predetermined posture, a Coanda airflow is produced even when the Coanda blades are housed in the housing portion. For example, with respect to the predetermined posture assumed by the horizontal blade 31, by causing the first Coanda blade 33 to assume a posture in which the relative angle between the first Coanda blade 33 and the horizontal blade 31 becomes an angle equal to or less than the predetermined angle and in which the first Coanda blade 33 is inclined forward and upward and causing the second Coanda blade 34 to assume a posture in which it is housed in the housing portion 60 like in an air conditioning indoor unit 110 shown in FIG. 8, all of the outlet air can be changed to Coanda airflows along the outside surface 33*a* of the first Coanda blade 33 and the outside surface 34*a* of the second Coanda blade 34. At this time, the portion of the outlet air that has become the Coanda airflow along the outside surface 33*a* of the first Coanda blade 33 is blown out in the direction of the ceiling. Meanwhile, the rest of the outlet air that has become the Coanda airflow along the outside surface 34*a* of the second Coanda blade 34 is guided to the air inlet 19 via the front surface panel 11*b*.

In this way, even when all of the outlet air is changed to a Coanda airflow, an air direction heading toward the air inlet 19 and an air direction heading in the direction of the ceiling can be simultaneously formed. Additionally, some of the outlet air can be short-circuited to enhance the dehumidification capability while the room air can be circulated by the rest of the outlet air blown out in the direction of the ceiling.

(5-5) Example Modification 1E

In the above embodiment, the horizontal blade 31 is a single plate-like member and the Coanda blade 32 is divided into two blades in the lengthwise direction.

Figure 9:
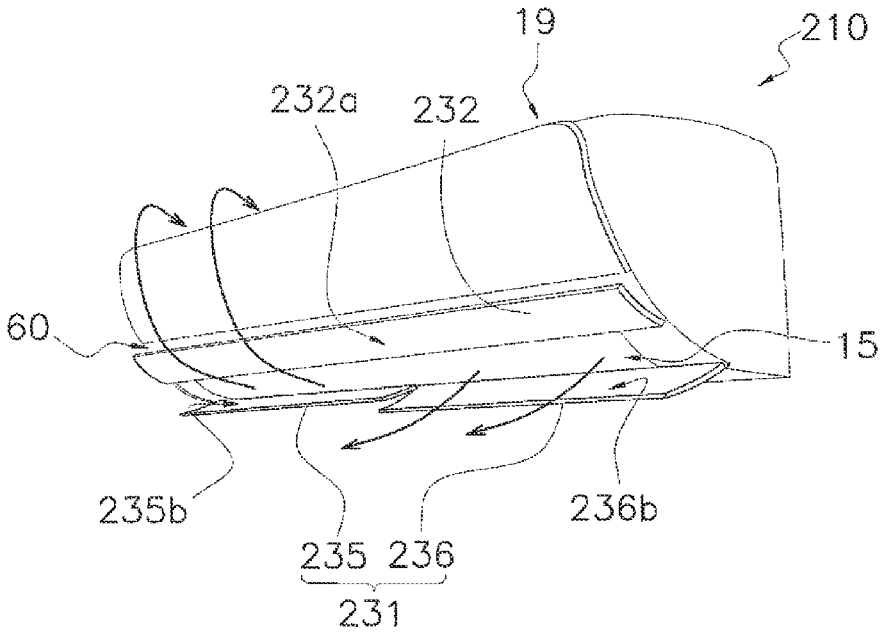
FIG. 9 is a perspective view of an air conditioning indoor unit pertaining to example modification 1E during operation.

Instead of this, the Coanda blade may be a single plate-like member and the horizontal blade may be divided into plural blades in the lengthwise direction. For example, an air conditioning indoor unit 210 in which the horizontal blade is divided into two blades in the lengthwise direction as shown in FIG. 9 will be described below. In the description below, the same reference signs are used for constituent parts that are the same as those in the above embodiment.

In a case where a Coanda blade 232 is a single plate-like member and a horizontal blade 231 includes a first horizontal blade 235 and a second horizontal blade 236 that are adjacent to one another in the lengthwise direction (right and left direction), the control unit independently drives the first horizontal blade 235 and the second horizontal blade 236 so that the first horizontal blade 235 and the second horizontal blade 236 can be caused to assume different postures. For this reason, for example, with respect to the Coanda blade 232 assuming a predetermined posture, by causing the first horizontal blade 235 to assume a posture in which a Coanda airflow along an outside surface 232*a* of the Coanda blade 232 is produced, that is, causing the first horizontal blade 235 to assume a posture in which the relative angle between the Coanda blade 232 and the first horizontal blade 235 becomes an angle equal to or less than the predetermined angle, and causing the second horizontal blade 236 to assume a posture in which a Coanda airflow along the outside surface 232*a* of the Coanda blade 232 is not produced, that is, causing the second horizontal blade 236 to assume a posture in which the relative angle between the Coanda blade 232 and the second horizontal blade 236 becomes an angle greater than the predetermined angle, it can be brought about that some of the outlet air whose air direction has been adjusted by an inside surface 235*b* of the first horizontal blade 235 becomes a Coanda airflow along the outside surface 232*a* of the Coanda blade 232 while the rest of the outlet air whose air direction has been adjusted by an inside surface 236*b* of the second horizontal blade 236 does not become a Coanda airflow along the outside surface 232*a* of the Coanda blade 232. As a result, the air direction of some of the outlet air is changed by the first horizontal blade 235 and is thereafter changed by the Coanda effect, while the air direction of the rest of the outlet air is changed by the second horizontal blade 236 and is thereafter maintained as is because it is not changed by the Coanda effect. Because of this, an air direction utilizing a Coanda airflow and an air direction not utilizing a Coanda airflow (the air direction changed by the second horizontal blade 236) can be simultaneously formed.

Furthermore, FIG. 9 shows the portion of the outlet air that has become the Coanda airflow on part of the outside surface 232*a* of the Coanda blade 232 short-circuiting, but by adjusting the postures of the first horizontal blade 235, the second horizontal blade 236, and the Coanda blade 232, the direction in which the Coanda airflow heads can be adjusted.

Furthermore, the air conditioning indoor unit may also have a configuration in which the Coanda blade is divided into plural blades (two or more blades) in the lengthwise direction, the horizontal blade is divided into plural blades (two or more blades) in the lengthwise direction, and each of the Coanda blades and each of the horizontal blades are independently driven.

For example, in an air conditioning indoor unit equipped with a first Coanda blade, a second Coanda blade that is adjacent to the first Coanda blade in the lengthwise direction, a first horizontal blade that opposes the first Coanda blade, and a second horizontal blade that opposes the second Coanda blade and is adjacent to the first horizontal blade in the lengthwise direction, by causing the first Coanda blade and the second Coanda blade to assume different postures and causing the first horizontal blade and the second horizontal blade to assume different postures, the relative angle between the first horizontal blade and the first Coanda blade and the relative angle between the second horizontal blade and the second Coanda blade can be changed to different angles. Because the first Coanda blade, the second Coanda blade, the first horizontal blade, and the second horizontal blade are independently driven, the first Coanda blade and the second Coanda blade can also be caused to assume the same posture and the first horizontal blade and the second horizontal blade can also be caused to assume the same posture. Consequently, the number of variations of air directions can be further increased compared to the above embodiment.

Moreover, in a case where the Coanda blade and/or the horizontal blade is divided into three or more blades in the lengthwise direction and the Coanda blade(s) and/or the horizontal blade(s) that have been divided are independently driven, for example, it can also be brought about that some of the outlet air blown out from the central section of the air outlet is changed to a Coanda airflow while the rest of the outlet air blown out from both end sections of the air outlet is not changed to a Coanda airflow. In so doing, for example, by changing the portion of the outlet air blown out from the central section of the air outlet to a Coanda airflow heading toward the ceiling and changing the rest of the outlet air blown out from both end sections of the air outlet into airflows along the inside surface(s) of the horizontal blade(s), an enveloping airflow can be formed with the outlet air overall.

(5-6) Example Modification 1F

In the above embodiment, the sum total of the lengthwise direction dimensions of the first Coanda blade 33 and the second Coanda blade 34 is substantially the same as the lengthwise direction dimension of the air conditioning indoor unit 10, and the first Coanda blade 33 and the second Coanda blade 34 are designed in such a way that the sum total of their lengthwise direction dimensions is greater than the lengthwise direction dimension of the air outlet 15.

However, as long as plural air directions can be simultaneously formed as air directions of the outlet air, the configuration of the Coanda blade is not limited to this.

For example, just one Coanda blade having a shorter dimension than the lengthwise direction dimension of the air outlet may also be disposed. In an air conditioning indoor unit designed in such a way that the lengthwise direction of the air outlet and the lengthwise direction of the Coanda blade are parallel, if the lengthwise direction dimension of the Coanda blade is shorter than the lengthwise direction dimension of the air outlet, with respect to the outlet air blown out from the air outlet, a Coanda airflow along the outside surface of the Coanda blade is produced in the section having the Coanda blade while a Coanda airflow along the outside surface of the Coanda blade is not produced in the section not having the Coanda blade. Consequently, in an air conditioning indoor unit equipped with a Coanda blade whose lengthwise direction dimension is shorter than the lengthwise direction dimension of the air outlet, it can be brought about that some of the outlet air blown out from the air outlet is changed to a Coanda airflow along the outside surface of the Coanda blade while the rest of the outlet air is not changed to a Coanda airflow along the outside surface of the Coanda blade, so an air direction utilizing a Coanda airflow and an air direction not utilizing a Coanda airflow can be simultaneously formed.

As an example of this kind of air conditioning indoor unit, a case where a Coanda blade 332 is positioned higher than the upper end portion of the air outlet 15 and in a central lower portion of an air conditioning indoor unit 310 as seen in a front view will be described below. In the description below, the same reference signs are used for constituent parts that are the same as those in the above embodiment.

Figure 10:
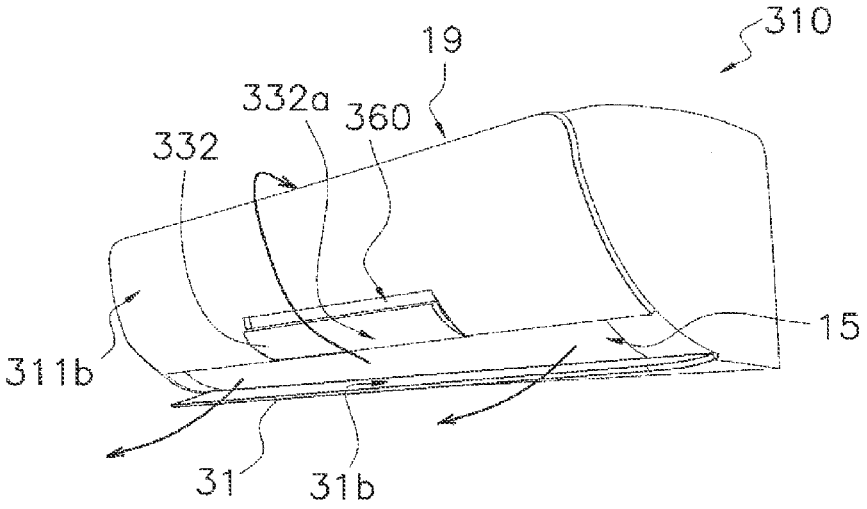
FIG. 10 is a perspective view of an air conditioning indoor unit pertaining to example modification 1F during operation.

In the air conditioning indoor unit 310 in which the Coanda blade 332 is positioned higher than the upper end portion of the air outlet 15 and in the central lower portion of the air conditioning indoor unit 310 as seen in a front view, by setting the postures of the Coanda blade 332 and the horizontal blade 31 in such a way that the relative angle between the Coanda blade 332 and the horizontal blade 31 becomes an angle equal to or less than the predetermined angle and at which a Coanda airflow along an outside surface 332*a* of the Coanda blade 332 is produced and in such a way that the relative angle between the surface of a front surface panel 311*b* and the horizontal blade 31 becomes an angle greater than the predetermined angle and at which an airflow along the surface of the front surface panel 311*b* is not produced, as shown in FIG. 10. it can be brought about that just some of the outlet air adjusted by the inside surface 31*b* of the horizontal blade 31 is changed to a Coanda airflow along the outside surface 332*a* of the Coanda blade 332 while the rest of the outlet air is not changed to an airflow along the outside surface 332*a* of the Coanda blade 332 or the front surface panel 311*b*. As a result, an air direction utilizing a Coanda airflow and an air direction not utilizing a Coanda airflow can be simultaneously formed.

FIG. 10 shows the portion of the outlet air that has become the Coanda airflow along the outside surface 332*a* of the Coanda blade 332 being guided to the neighborhood of the air inlet 19 and sucked in from the air inlet 19 while the rest of the outlet air that has not become a Coanda airflow along the Coanda blade 332 or the front surface panel 311*b* has an air direction along the inside surface 31*b* of the horizontal blade 31, but by adjusting the posture of the Coanda blade 332 and/or the horizontal blade 31, the direction in which the Coanda airflow heads can be adjusted. For example, by adjusting the postures of the Coanda blade 332 and the horizontal blade 31, the portion of the outlet air blown out from the central section of the air outlet 15 can be changed to a Coanda airflow and given an air direction heading in the direction of the ceiling while the rest of the outlet air blown out from both end sections of the air outlet 15 is given an air direction along the inside surface 31*b* of the horizontal blade 31. In this way, by changing the portion of the outlet air blown out from the central section of the air outlet 15 to a Coanda airflow and giving it an air direction heading in the direction of the ceiling while giving the rest of the outlet air blown out from both end sections of the air outlet 15 an air direction along the inside surface 31*b* of the horizontal blade 31, an enveloping airflow can be formed with the outlet air overall.

Figure 11:
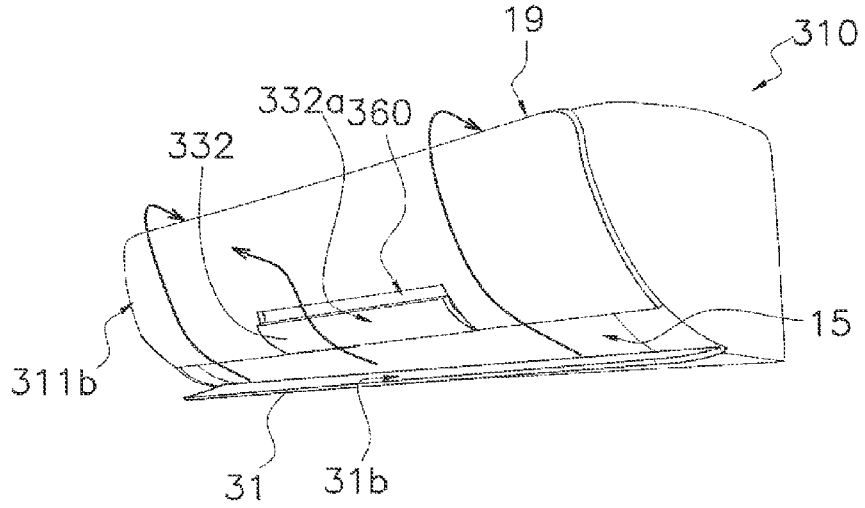
FIG. 11 is a perspective view of the an conditioning indoor unit pertaining to example modification 1F during operation.

Furthermore, by setting the postures of the Coanda blade 332 and the horizontal blade 31 in such a way that the relative angle between the Coanda blade 332 and the horizontal blade 31 becomes an angle equal to or less than the predetermined angle and at which a Coanda airflow along the outside surface 332*a* of the Coanda blade 332 is produced and in such a way that the relative angle between the surface of the front surface panel 311*b* and the horizontal blade 31 becomes an angle equal to or less than the predetermined angle and at which an airflow along the surface of the front surface panel 311*b* is produced, as shown in FIG. 11, some of the outlet air adjusted by the inside surface 31*b* of the horizontal blade 31 can also be changed to a Coanda airflow along the outside surface 332*a* of the Coanda blade 332 while the rest of the outlet air is changed to airflows along the surface of the front surface panel 311*b*.

FIG. 11 shows the portion of the outlet air that has become the Coanda airflow along the outside surface 332*a* of the Coanda blade 332 taking an air direction heading in the direction of the ceiling without being guided to the neighborhood of the air inlet 19 while the rest of the outlet air that has become the airflows along the surface of the front panel 311*b* is guided to the neighborhood of the air inlet 19 and sucked in from the air inlet 19, but by adjusting the posture of the horizontal blade 31, it can also be brought about that the outlet air does not become airflows along the surface of the front surface panel 311*b*.

In this way, in the air conditioning indoor unit 310 in which the Coanda blade 332 is positioned higher than the upper end portion of the air outlet 15 and in the central lower portion of the air conditioning indoor unit 310 as seen in a front view, by adjusting the postures of the Coanda blade 332 and the horizontal blade 31, an air direction utilizing a Coanda airflow and an air direction not utilizing a Coanda airflow can be simultaneously formed, so diverse variations of air directions can be formed. Furthermore, by causing some of the outlet air to short-circuit in such a way that the Coanda airflow is guided to the neighborhood of the air inlet 19 and giving the rest of the outlet air an air direction heading forward, the dehumidification capability can be enhanced while the room air can be stirred.

In FIG. 10 and FIG. 11, reference sign 360 represents a housing portion that is disposed in the front surface panel 311*b* and can house the Coanda blade 332.

<Second Embodiment>

An air conditioning indoor unit 410 pertaining to a second embodiment of the present invention will be described below.

(1) Configuration of Air Conditioning Indoor Unit

Figure 12:
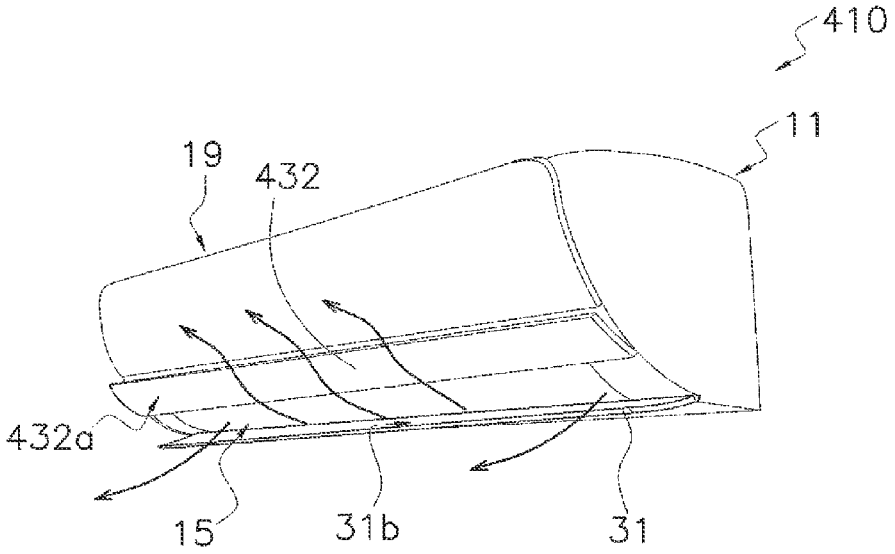
FIG. 12 is a perspective view of an air conditioning indoor unit pertaining to a second embodiment of the present invention during operation.
Figure 13:
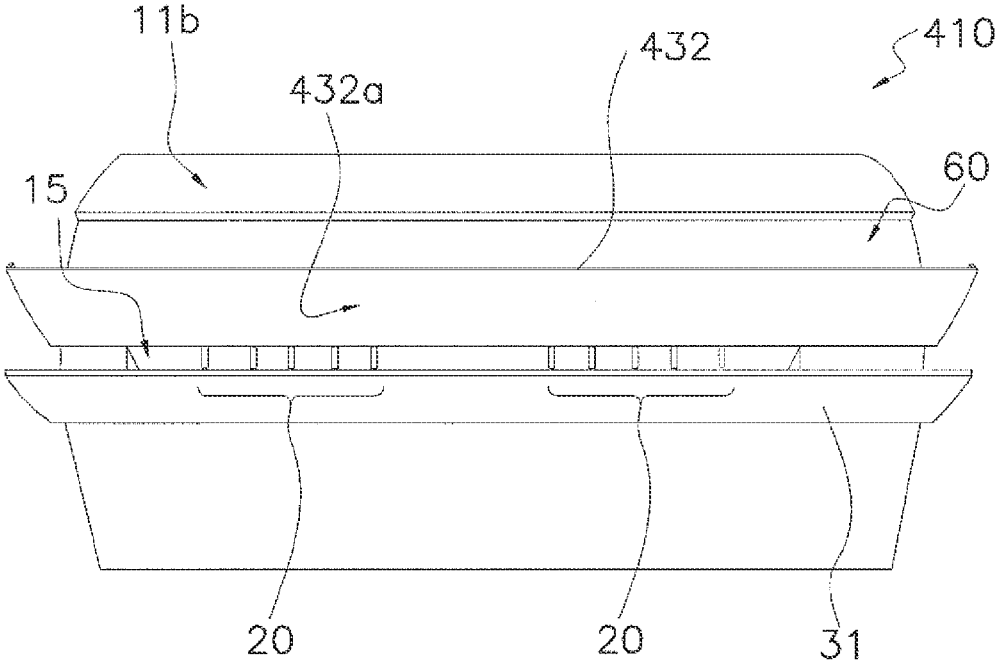
FIG. 13 is a view, as seen from below, of the air conditioning indoor unit pertaining to the second embodiment of the present invention during operation.

FIG. 12 is a perspective view of the air conditioning indoor unit 410 pertaining to the second embodiment of the present invention during execution of a Coanda airflow utilization mode. FIG. 13 is a view of the air conditioning indoor unit 410 during execution of the Coanda airflow utilization mode as seen from below.

The air conditioning indoor unit 410 is a wall-mounted air conditioning indoor unit attached to a wall surface in a room and is equipped with a body casing 11, an indoor heat exchanger, an indoor fan, a bottom frame, and a control unit. In the air conditioning indoor unit 410 of the second embodiment, parts other than the configuration of a Coanda blade 432 have the same configurations as those in the first embodiment, so in the description below, description will be given using the same reference signs as those in the first embodiment and description of each part will be omitted.

(2) Coanda Blade

As shown in FIG. 12, the Coanda blade 432 is an undivided, single plate-like member and is designed in such a way that the lengthwise direction dimension of the Coanda blade 432 is equal to or greater than the lengthwise direction dimension of the horizontal blade 31. Furthermore, the Coanda blade 432 can cooperate with the horizontal blade 31 to utilize the Coanda effect to change the outlet air to a Coanda airflow along an outside surface 432*a* of the Coanda blade 432.

The Coanda blade 432 is housed in the housing portion 60 while air conditioning operations are stopped and during operation in a normal blowing mode.

Furthermore, the Coanda blade 432 moves away from the housing portion 60 by rotating and assumes postures in which it is inclined in the front and rear direction. A rotating shaft of the Coanda blade 432 is disposed in the neighborhood of the lower end of the housing portion 60 and in a position inside the body casing 11 (a position above an upper wall of the outlet air flow path), and the lower end portion of the Coanda blade 432 and the rotating shaft are coupled together while maintaining a predetermined distance between them. Thus, as the rotating shaft rotates so that the upper end portion of the Coanda blade 432 moves away from the housing portion 60 of the front surface panel 11*b*, the height position of the lower end of the Coanda blade 432 becomes lower. Furthermore, the inclination of the Coanda blade 432 when it has rotated open is gentler than the inclination of the front surface panel 11*b*.

Furthermore, when the rotating shaft rotates in a predetermined direction, both the upper end portion and the lower end portion of the Coanda blade 432 move away from the housing portion 60 while describing a circular arc, but at this time, the shortest distance between the upper end portion of the Coanda blade 432 and the housing portion 60 is greater than the shortest distance between the lower end portion of the Coanda blade 432 and the housing portion 60. Additionally, when the rotating shaft rotates in the opposite direction of the predetermined direction, the Coanda blade 432 moves closer to the housing portion 60 and eventually is housed in the housing portion 60.

The postures of the Coanda blade 432 include a posture in which the Coanda blade 432 is housed in the housing portion 60, a posture in which the Coanda blade 432 rotates to become inclined forward and upward, a posture in which the Coanda blade 432 further rotates to become substantially horizontal, and a posture in which the Coanda blade 432 further rotates to become inclined forward and downward.

Furthermore, the outside surface 432*a* of the Coanda blade 432 is finished to a gentle, circular arcuate curved surface that is outwardly convex in such a way as to lie on an extension of the gentle, circular arcuate curved surface of the front surface panel 11*b* in a state in which the Coanda blade 432 is housed in the housing portion 60. Furthermore, an inside surface of the Coanda blade 432 is finished to a circular arcuate curved surface that follows the surface of the housing portion 60.

In the present embodiment, the outside surface 432*a* of the Coanda blade 432 is a circular arcuate curved surface, but the outside surface of the Coanda blade 432 may also be a flat surface.

(3) Directional Control of Outlet Air

Figure 14:
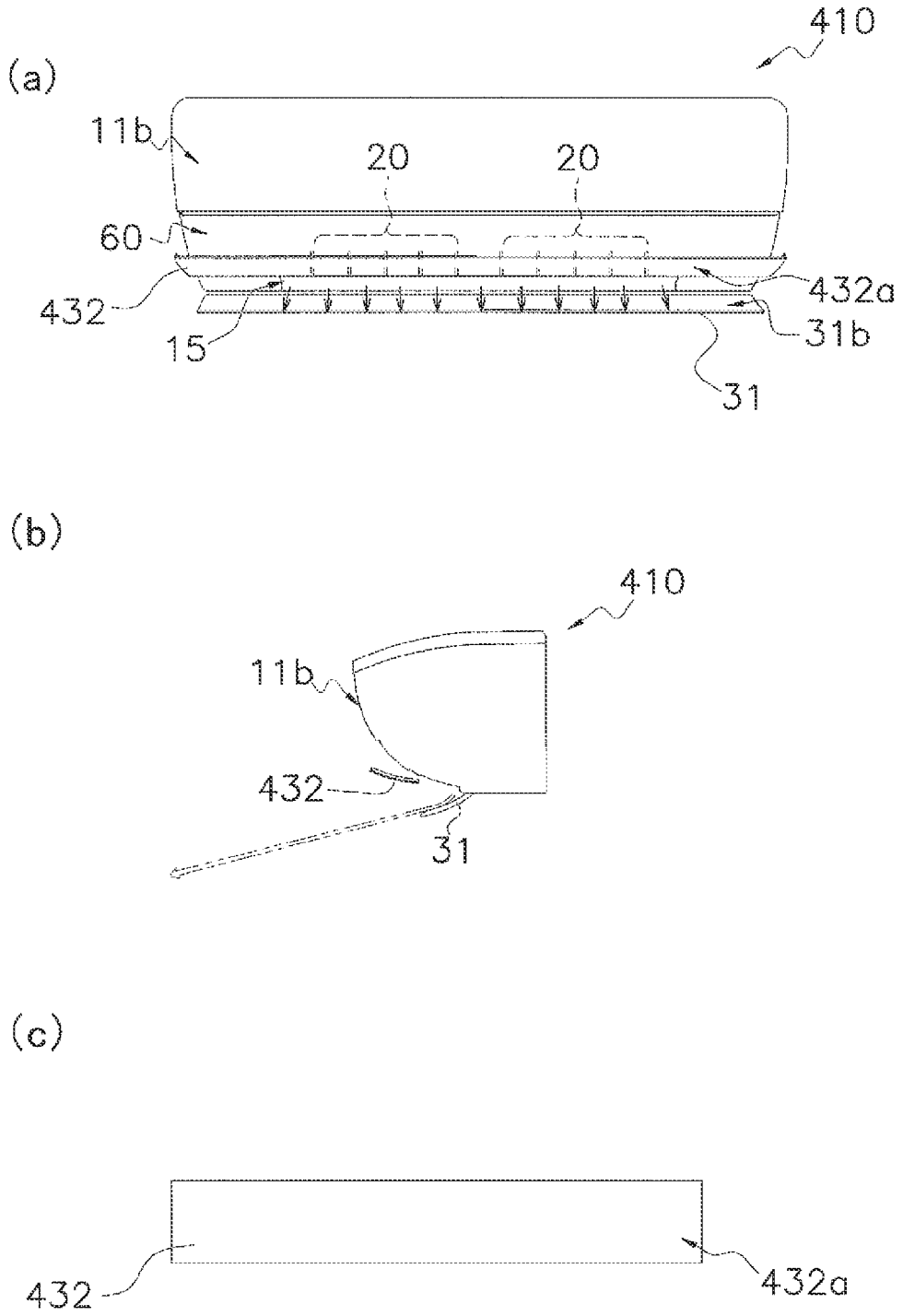
FIGS. 14(*a*) to 14(*c*) are views showing an example of the air conditioning indoor unit during operation, with FIG. 14(*a*) being a front view of the air conditioning indoor unit, FIG. 14(*b*) being a side view of the air conditioning indoor unit, and FIG. 14(*c*) being a schematic view showing a flow of the outlet air on an outside surface of a Coanda blade.
Figure 15:
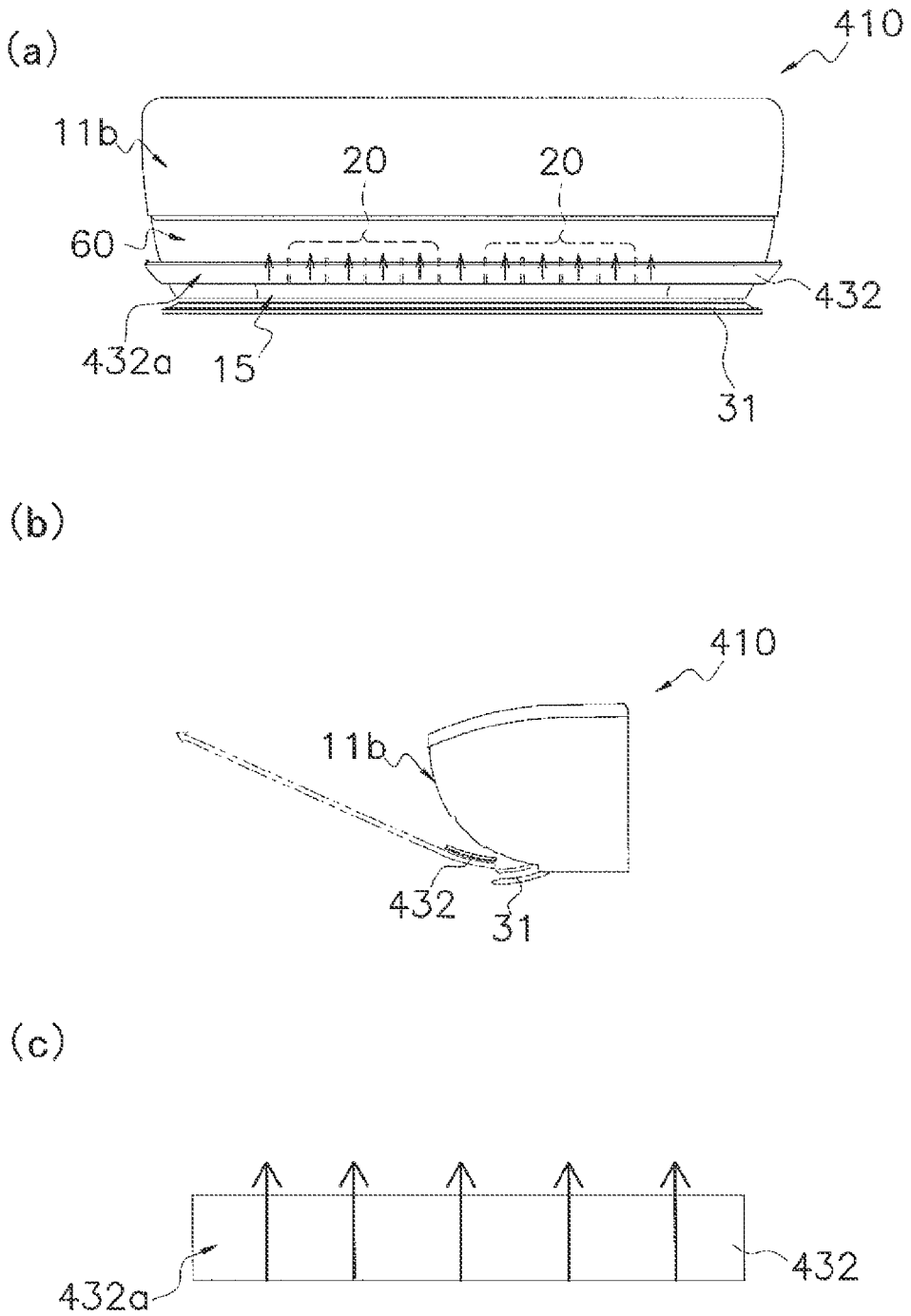
FIGS. 15(*a*) to 15(*c*) are views showing an example of the air conditioning indoor unit during operation, with FIG. 15(*a*) being a front view of the air conditioning indoor unit, FIG. 15(*b*) being a side view of the air conditioning indoor unit, and FIG. 15(*c*) being a schematic view showing a flow of the outlet air on the outside surface of the Coanda blade.

FIGS. 14(*a*) to 14(*c*) are views showing an example of the normal blowing mode of the air conditioning indoor unit 410, with FIG. 14(*a*) being a front view of the air conditioning indoor unit 410, FIG. 14(*b*) being a side view, and FIG. 14(*c*) being a view showing a flow of the outlet air on the outside surface 432*a* of the Coanda blade 432. FIGS. 15(*a*) to 15(*c*) and FIGS. 16(*a*) to 16(*c*) are views showing examples of the Coanda airflow utilization mode of the air conditioning indoor unit 410, with FIG. 15(*a*) and FIG. 16(*a*) being front views of the air conditioning indoor unit 410, FIG. 15(*b*) and FIG. 16(*b*) being side views, and FIG. 15(*c*) and FIG. 16(*c*) being views of flows of the outlet air on the outside surface 432*a* of the Coanda blade 432.

The air conditioning indoor unit 410 has, as means of controlling the direction of the outlet air, a normal blowing mode in which only the horizontal blade 31 is rotated to adjust the direction of the outlet air, a Coanda airflow utilization mode in which the Coanda blade 432 and the horizontal blade 31 are rotated to utilize the Coanda effect to change at least some of the outlet air to a Coanda airflow along the outside surface 432*a* of the Coanda blade 432, and a downward blowing mode in which the front ends of the horizontal blade 31 and the Coanda blade 432 are pointed forward and downward to guide the outlet air downward.

Furthermore, the postures of the horizontal blade 31 and the Coanda blade 432 change in each mode with each direction in which the air is blown out. The postures of the horizontal blade 31 and the Coanda blade 432 in each mode are preset and stored in a storage unit (not shown in the drawings) that the control unit has.

The user can select the blowing direction via the remote controller or the like. Furthermore, it is also possible for the changing of the modes and the blowing direction to be controlled in such a way that they are automatically changed.

(3-1) Normal Blowing Mode

The normal blowing mode is a mode in which only the horizontal blade 31 is rotated to adjust the direction of the outlet air (see FIG. 14). Control by the control unit in the normal blowing mode is the same as in the first embodiment, so description will be omitted here.

(3-2) Coanda Airflow Utilization Mode

As described also in the first embodiment, in order to change the outlet air to a Coanda airflow along the outside surface 432*a* of the Coanda blade 432, it is necessary to change the relative angle between the Coanda blade 432 and the horizontal blade 31 to an angle equal to or less than the predetermined angle.

In this connection, when the relative angle between the Coanda blade 432 and the horizontal blade 31 is gradually increased from an angle smaller than the predetermined angle in a state in which the posture of the vertical blades 20 is fixed, the outlet air that had been a stable Coanda airflow on the entire region of the outside surface 432*a* of the Coanda blade 432 (see FIG. 15) becomes a Coanda airflow on part of the outside surface 432*a* of the Coanda blade 432 but becomes unstable airflows that do not result in a Coanda airflow on other parts of the outside surface 432*a* of the Coanda blade 432 (see FIG. 16), and when the relative angle between the Coanda blade 432 and the horizontal blade 31 is further increased, the outlet air becomes an airflow along the inside surface 31*b* of the horizontal blade 31 without becoming a Coanda airflow on the outside surface 432*a* of the Coanda blade 432 (see FIG. 14).

From this, the angular range of the relative angle between the Coanda blade 432 and the horizontal blade 31 can be divided, by the state of the Coanda airflow, into an angular range (hereinafter called a first angular range) that results in a state (hereinafter called a first airflow state) in which a stable Coanda airflow is produced on the entire region of the outside surface 432*a* of the Coanda blade 432, an angular range (hereinafter called a third angular range) that results in a state (hereinafter called a third airflow state) in which a Coanda airflow is produced on part (the central part) of the outside surface 432*a* of the Coanda blade 432 but a Coanda airflow is not produced on other parts (both side end portions) of the outside surface 432*a* of the Coanda blade 432 and results in unstable airflows, and an angular range (hereinafter called a second angular range) that results in a state (hereinafter called a second airflow state) in which a Coanda airflow is not produced at all on the outside surface 432*a* of the Coanda blade 432.

This will be described in greater detail using FIG. 17, which is a drawing for describing the relationship between the outlet air and combinations (blade angle combinations) of postures of the Coanda blade 432 and the horizontal blade 31.

Figure 17:
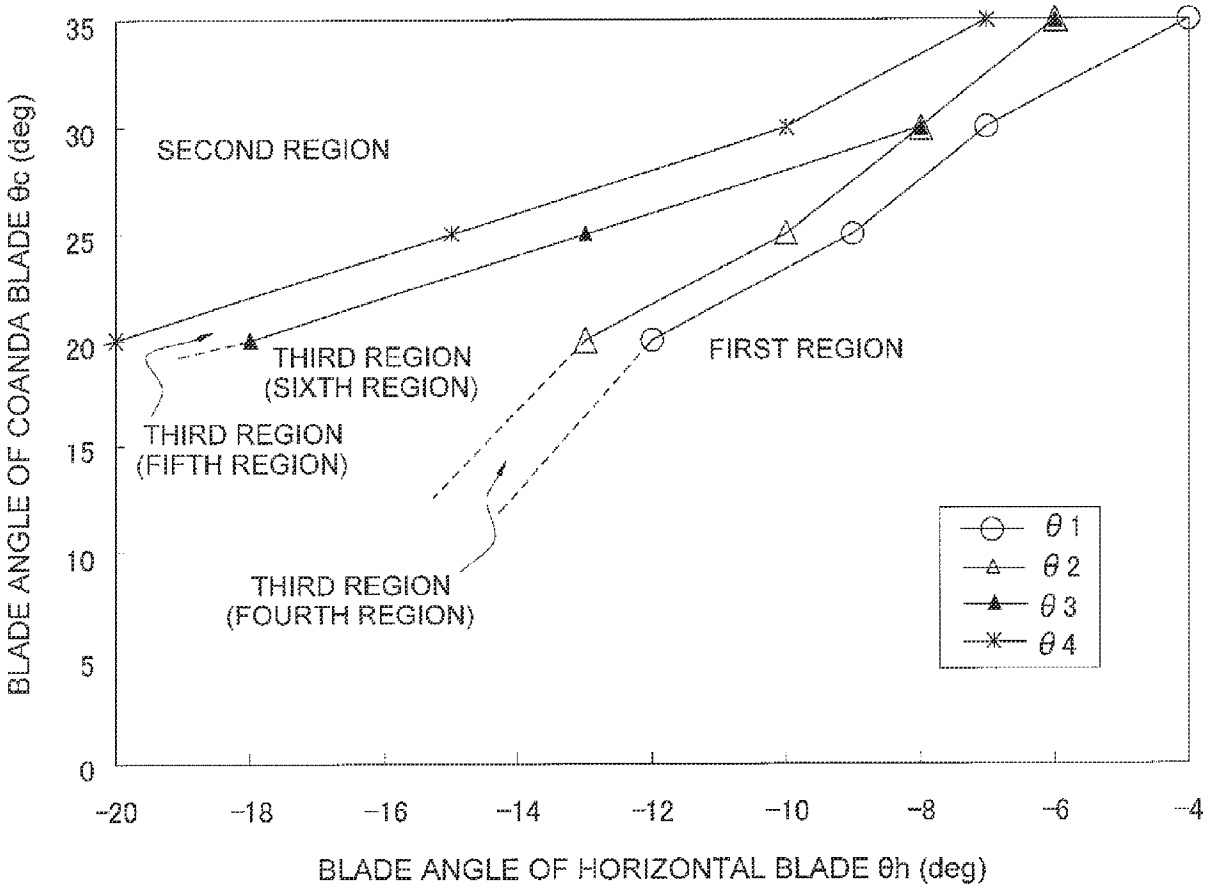
FIG. 17 is a drawing for describing the relationship between the outlet air and blade angles of the Coanda blade and a horizontal blade.
Figure 18:
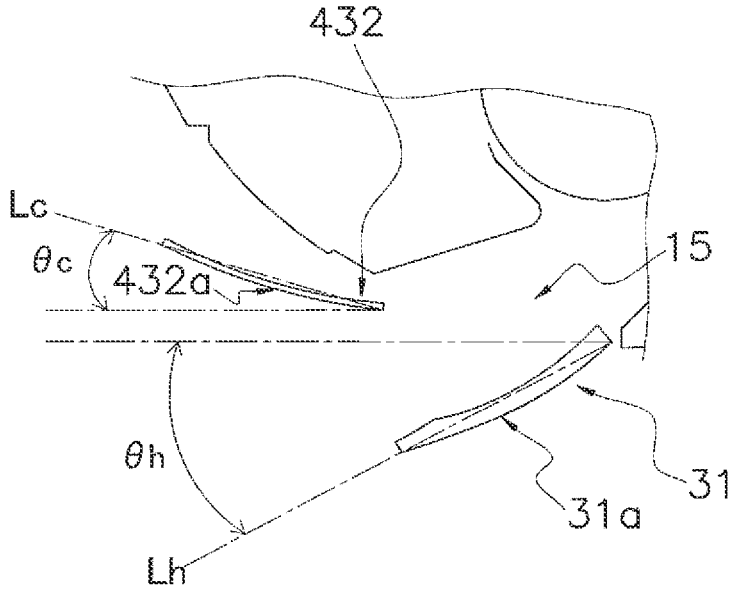
FIG. 18 is a drawing for describing the blade angle of the Coanda blade and the blade angle of the horizontal blade.

In FIG. 17, θ1 represents a blade angle combination of the Coanda blade 432 and the horizontal blade 31 when the airflow state has been a switch from the third airflow state to the first airflow state in a state in which the vertical blades 20 are fixed in a posture (hereinafter called a forward blowing posture) in which the outlet air is blown out in a forward direction from the air outlet 15, θ2 represents a blade angle combination of the Coanda blade 432 and the horizontal blade 31 when the airflow state has been a switch from the first airflow state to the third airflow state in a state in which the vertical blades 20 are fixed in the forward blowing posture, θ3 represents a blade angle combination of the Coanda blade 432 and the horizontal blade 31 when the airflow state has been a switch from the second airflow state to the third airflow state in a state in which the vertical blades 20 are fixed in the forward blowing posture, and θ4 represents a blade angle combination of the Coanda blade 432 and the horizontal blade 31 when the airflow state has been a switch from the third airflow state to the second airflow state in a state in which the vertical blades 20 are fixed in the forward blowing posture. Furthermore, the blade angle θh of the horizontal blade 31 shown in FIG. 17 is, as shown in FIG. 18, an angle between a horizontal line and a straight line Lh joining the front and rear ends of the outside surface 31*a* of the horizontal blade 31. Additionally, the blade angle θc of the Coanda blade 432 shown in FIG. 17 is an angle between the horizontal line and a straight line Lc joining the front and rear ends of the outside surface 432*a* of the Coanda blade 432. Here, the blade angle θh and the blade angle θc are not absolute values and are negative values in a case where they become lower than the horizontal line. Additionally, the open angle (relative angle) θ between the horizontal blade 31 and the Coanda blade 432 can be given by the equation θ=θc−θh. FIG. 17 shows results of having performed an evaluation test by fixing, without changing, the air volume of the indoor fan 14 at a predetermined air volume and changing the blade angle (posture) of the horizontal blade 31 with respect to the Coanda blade 432.

For example, when the blade angle θh of the horizontal blade 31 is set equal to or less than −15 degrees (so as to become farther away from 0 degrees) in a case where the vertical blades 20 are fixed in the forward blowing posture and the blade angle θc of the Coanda blade 432 is fixed at 25 degrees, this results in the second airflow state. Furthermore, for example, when the blade angle θh of the horizontal blade 31 is set equal to or greater than −9 degrees (so as to become closer to 0 degrees) in a case where the vertical blades 20 are fixed in the forward blowing posture and the blade angle θc of the Coanda blade 432 is fixed at 25 degrees, this results in the first airflow state. Moreover, when the blade angle θh of the horizontal blade 31 is set to −1 degrees or −12 degrees in a case where the blade angle θc of the Coanda blade 432 is fixed at 25 degrees, this results in the third airflow state.

In this way, as blade angle combinations of the Coanda blade 432 and the horizontal blade 31 in a case where the posture of the vertical blades 20 is the forward blowing posture, between a blade angle combination region that results in the first airflow state (a blade angle combination region in which the relative angle between the Coanda blade 432 and the horizontal blade 31 is smaller than the blade angle combination θ1 shown in FIG. 17; hereinafter called a first region) and a blade angle combination region that results in the second airflow state (a blade angle combination region in which the relative angle between the Coanda blade 432 and the horizontal blade 31 is greater than the blade angle combination θ4 shown in FIG. 17; hereinafter called a second region), there exists a blade angle combination region that results in the third airflow state (a blade angle combination region sandwiched between the blade angle combination θ1 and the blade angle combination θ4 shown in FIG. 17; hereinafter called a third region).

Additionally, a blade angle combination in which the relative angle between the Coanda blade 432 and the horizontal blade 31 is in a predetermined angle in the first angular range is included in the first region, a blade angle combination in which the relative angle between the Coanda blade 432 and the horizontal blade 31 is in a predetermined angle in the second angular range is included in the second region, and a blade angle combination in which the relative angle between the Coanda blade 432 and the horizontal blade 31 is in a predetermined angle in the third angular range is included in the third region.

Furthermore, because there is the third angular range between the first angular range and the second angular range, it can be said that the predetermined angle in the first angular range is smaller than the predetermined angle in the third angular range and that the predetermined angle in the second angular range is greater than the predetermined angle in the third angular range.

The state in which "the outlet air is a Coanda airflow on the entire region of the outside surface of the Coanda blade 432" includes a state in which the outlet air is a flow attached to the entire region of the outside surface of the Coanda blade 432 and a state in which, in a case where the lengthwise direction dimension of the Coanda blade 432 is longer than the lengthwise direction dimension of the air outlet like in the present embodiment, for example, the outlet air is a flow attached to the entire region of the section of the outside surface of the Coanda blade 432 that opposes the air outlet.

Figure 16:
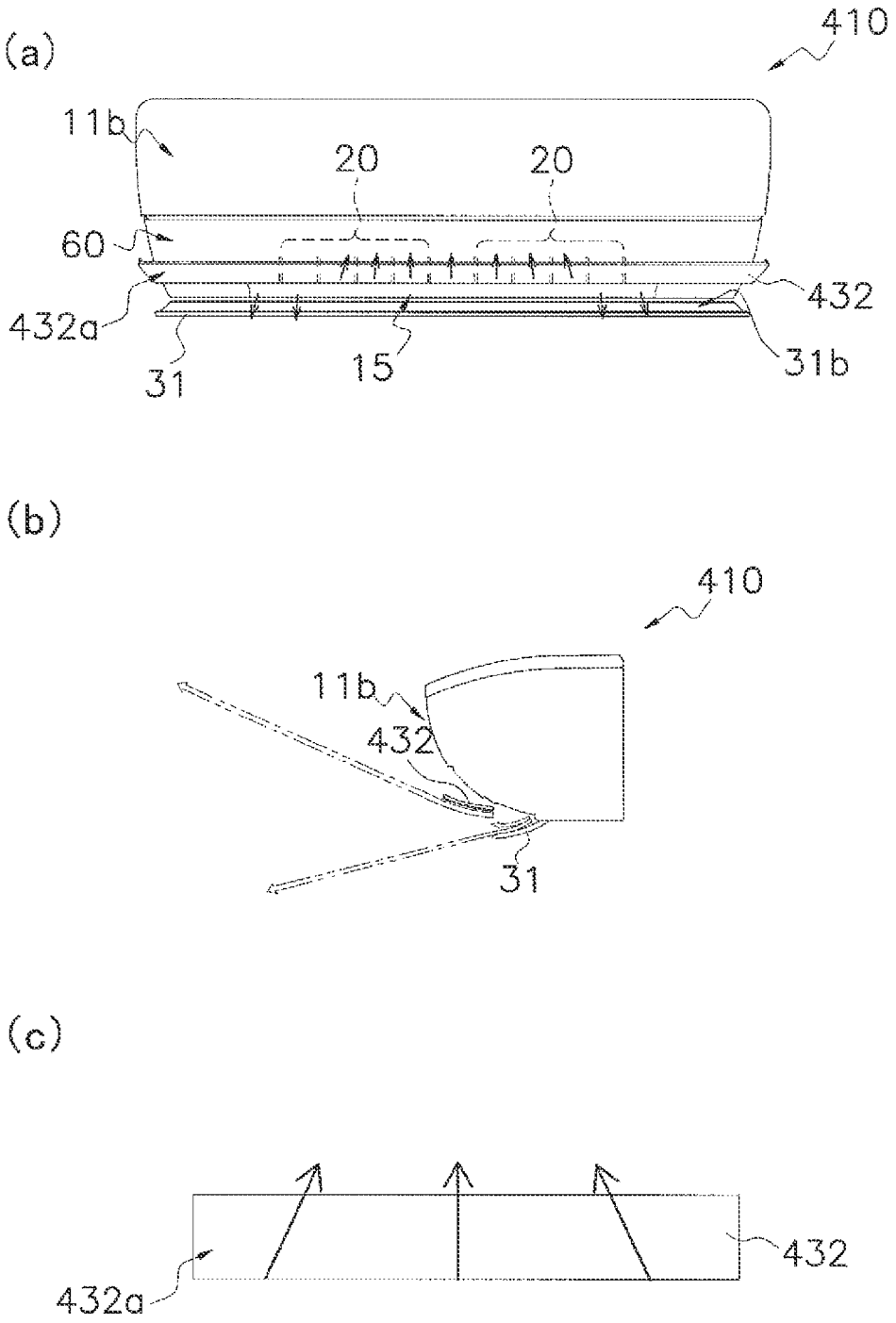
FIGS. 16(*a*) to 16(*c*) are views showing an example of the air conditioning indoor unit during operation, with FIG. 16(*a*) being a front view of the air conditioning indoor unit, FIG. 16(*b*) being a side view of the air conditioning indoor unit, and FIG. 16(*c*) being a schematic view showing a flow of the outlet air on the outside surface of the Coanda blade.

Furthermore, in a case where the blade angle combination of the Coanda blade 432 and the horizontal blade 31 is in the third region, the airflows on both end portions of the outside surface 432*a* of the Coanda blade 432 are flows deflected toward the center even if a Coanda airflow along the outside surface 432*a* of the Coanda blade 432 is being produced (see FIG. 16(*c*)). It is thought that this is because air on the sides of the Coanda blade 432 is drawn by the dynamic pressure of the Coanda airflow into the Coanda airflow from both end portions of the Coanda blade 432, so that the airflows along both end portions of the Coanda blade 432 are pushed by air from the sides and become unstable airflows toward the central portion. Additionally, by causing the Coanda blade 432 and the horizontal blade 31 to assume predetermined postures that result in a blade angle combination in the third region, as shown in FIGS. 16(*a*) to 16(*c*), some of the outlet air blown out from the neighborhoods of both end portions of the air outlet 15 becomes an airflow along the inside surface 31*b* of the horizontal blade 31.

Moreover, for example, when the blade angle θh of the horizontal blade 31 is gradually increased (so as to become closer to 0 degrees) from −12 degrees in a state in which the vertical blades 20 are fixed in the forward blowing posture and the blade angle θc of the Coanda blade 432 is fixed at 25 degrees, the airflow state is a switch from the third airflow state to the first airflow state when the blade angle θh of the horizontal blade 31 becomes −9 degrees. On the other hand, when the blade angle θh of the horizontal blade 31 is gradually decreased (so as to become farther away from 0 degrees) from −8 degrees in a state in which the vertical blades 20 are fixed in the forward blowing posture and the blade angle θc of the Coanda blade 432 is fixed at 25 degrees, the airflow state is a switch from the first airflow state to the third airflow state when the blade angle θh of the horizontal blade 31 becomes −10 degrees.

Furthermore, for example, when the blade angle θh of the horizontal blade 31 is gradually increased (so as to become closer to 0 degrees) from −20 degrees in a state in which the vertical blades 20 are fixed in the forward blowing posture and the blade angle θc of the Coanda blade 432 is fixed at 25 degrees, the airflow state is a switch from the second airflow state to the third airflow state when the blade angle θh of the horizontal blade 31 becomes −13 degrees. On the other hand, when the blade angle θh of the horizontal blade 31 is gradually decreased (so as to become farther away from 0 degrees) from −12 degrees in a state in which the vertical blades 20 are fixed in the forward blowing posture and the blade angle θc of the Coanda blade 432 is fixed at 25 degrees, the airflow state is a switch from the third airflow state to the second airflow state when the blade angle θh of the horizontal blade 31 becomes −15 degrees.

In this way, in a case where the vertical blades 20 are in the forward blowing posture, the relative angle of the blade angle combination θ1 when transitioning from the third airflow state to the first airflow state and the relative angle of the blade angle combination θ2 when transitioning from the first airflow state to the third airflow state are different. Moreover, in a case where the vertical blades 20 are in the forward blowing posture, the relative angle of the blade angle combination θ4 when transitioning from the third airflow state to the second airflow state and the relative angle of the blade angle combination θ3 when transitioning from the second airflow state to the third airflow state are different. In other words, the angle when transitioning from the first airflow state to the third airflow state in a case where the relative angle between the Coanda blade 432 and the horizontal blade 31 has been gradually increased from the predetermined angle in the first angular range and the angle when transitioning from the third airflow state to the first airflow state in a case where the relative angle between the Coanda blade 432 and the horizontal blade 31 has been gradually decreased from the predetermined angle in the third angular range are different, and the angle when transitioning from the second airflow state to the third airflow state in a case where the relative angle between the Coanda blade 432 and the horizontal blade 31 has been gradually decreased from the predetermined angle in the second angular range and the angle when transitioning from the third airflow state to the second airflow state in a case where the relative angle between the Coanda blade 432 and the horizontal blade 31 has been gradually increased from the predetermined angle in the third angular range are different.

From this, it was understood that in the blade angle combinations of the Coanda blade 432 and the horizontal blade 31 in a case where the vertical blades 20 are fixed in the forward blowing posture, the blade angle combination region (hereinafter called a fourth region) between the blade angle combination θ1 when transitioning from the third airflow state to the first airflow state and the blade angle combination θ2 when transitioning from the first airflow state to the third airflow state and the blade angle combination region (hereinafter called a fifth region) between the blade angle combination θ4 when transitioning from the third airflow state to the second airflow state and the blade angle combination θ3 when transitioning from the second airflow state to the third airflow state are hysteresis regions. That is, it was found the third region includes the fourth region, the fifth region, and a blade angle combination region (shown as a sixth region in FIG. 17) between the blade angle combination θ2 and the blade angle combination θ3.

Therefore, in the Coanda airflow utilization mode, in the "Coanda airflow ceiling blowing" and the "Coanda airflow forward blowing" that produce a stable Coanda airflow on the entire region of the outside surface 432*a* of the Coanda airflow 432, by setting the postures of the Coanda blade 432 and the horizontal blade 31 to predetermined postures that result in a blade angle combination in the first region, all of the outlet air can be changed to a Coanda airflow.

On the other hand, in the Coanda airflow utilization mode, in the "partial ceiling blowing" and the "dehumidification capability enhancement blowing" that produce a Coanda airflow on part of the outside surface 432*a* of the Coanda blade 432 but do not produce a Coanda airflow on other parts, by setting the postures of the Coanda blade 432 and the horizontal blade 31 to predetermined postures that result in a blade angle combination in the sixth region, it can be brought about that some of the outlet air is changed to a Coanda airflow while the rest of the outlet air is not changed to a Coanda airflow.

Because of this, just an air direction utilizing a Coanda airflow can be formed, or an air direction utilizing a Coanda airflow and an air direction not utilizing a Coanda airflow can be simultaneously formed.

(3-3) Downward Blowing Mode

The downward blowing mode is a mode in which the horizontal blade 31 and the Coanda blade 432 are rotated to adjust the direction of the outlet air. When the "downward blowing" has been selected by the user, the control unit rotates the horizontal blade 31 until the inside surface 31*b* of the horizontal blade 31 points downward. Next, the control unit rotates the Coanda blade 432 until the outside surface 432*a* of the Coanda blade 432 points downward. As a result, the outlet air passes between the horizontal blade 31 and the Coanda blade 432 and is blown out downward.

(4) Characteristics 4-1

In the present embodiment, in the "partial ceiling blowing" and the "dehumidification capability enhancement blowing" in the Coanda airflow utilization mode, by setting the postures of the Coanda blade 432 and the horizontal blade 31 to predetermined postures that result in a blade angle combination in the sixth region, it can be brought about that a Coanda airflow is produced on part of the outside surface 432*a* of the Coanda blade 432 while a Coanda airflow is not produced on other parts, so that an air direction utilizing a Coanda airflow and an air direction not utilizing a Coanda airflow can be simultaneously formed.

Because of this, in the Coanda airflow utilization mode, the number of variations of air directions can be increased compared to an air conditioning indoor unit in which just an air direction that changes all of the outlet air to a Coanda airflow is formed.

Moreover, because an air direction utilizing a Coanda airflow and an air direction not utilizing a Coanda airflow can be simultaneously formed, an enveloping airflow from the up and down direction can be created.

4-2

In the present embodiment, the Coanda blade 432 and the horizontal blade 31 are not divided into two or more blades, so the air conditioning indoor unit 410 can be manufactured at a lower cost compared to a case where the Coanda blade 432 is divided into two or more blades to simultaneously form an air direction utilizing a Coanda airflow and an air direction not utilizing a Coanda airflow like in the air conditioning indoor unit 10 of the first embodiment or where the horizontal blade 31 is divided into two or more blades to simultaneously form an air direction utilizing a Coanda airflow and an air direction not utilizing a Coanda airflow.

Furthermore, in a case where an air direction utilizing a Coanda airflow and an air direction not utilizing a Coanda airflow are simultaneously formed, by setting the postures of the Coanda blade 432 and the horizontal blade 31 in such a way that the Coanda airflow is guided to the neighborhood of the air inlet 19, some of the outlet air that has become the Coanda airflow can be short-circuited, so the dehumidification capability can be enhanced with the portion of the outlet air that has been short-circuited while the room is air conditioned with the rest of the outlet air.

(5) Example Modifications (5-1) Example Modification 2A

Figure 19:
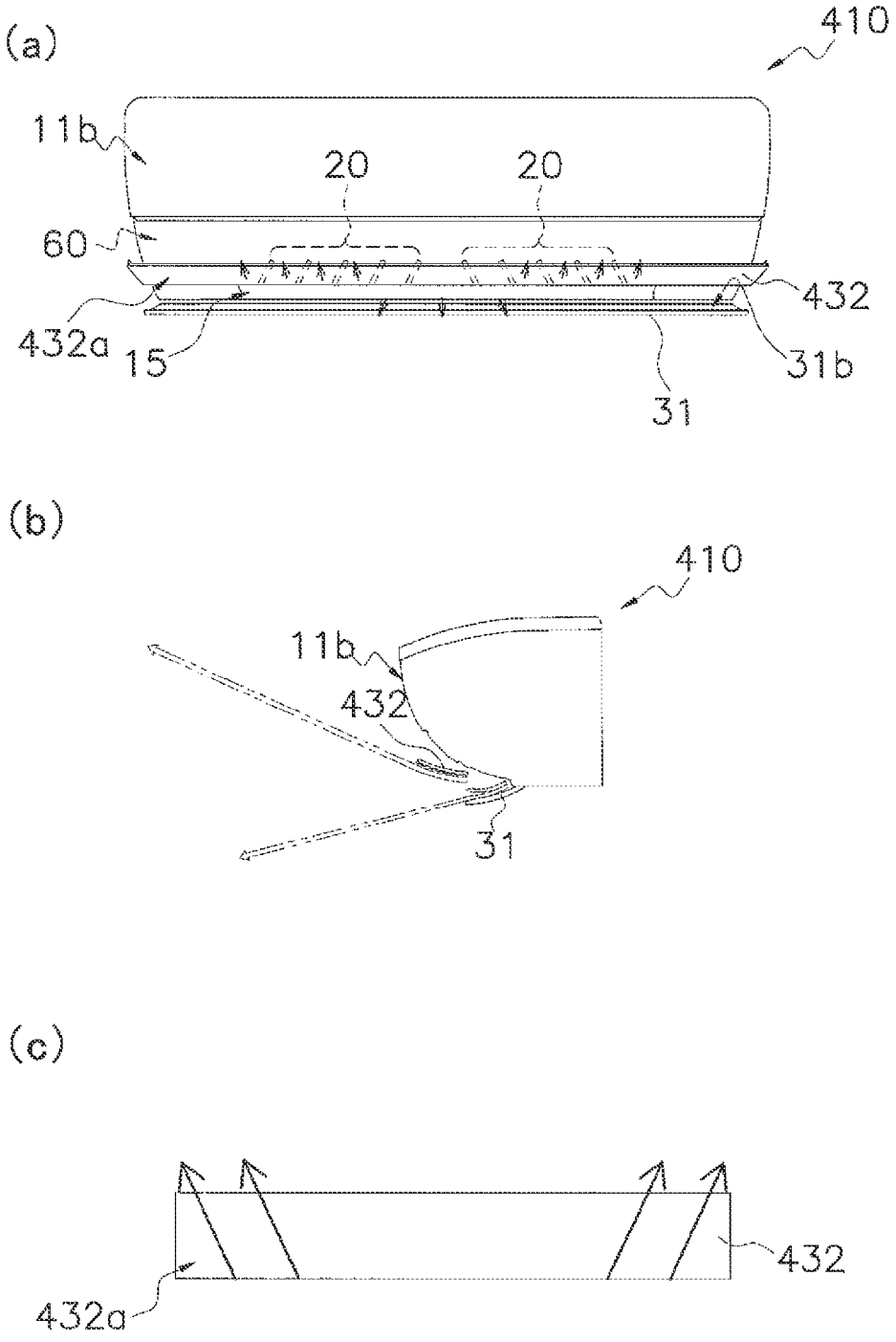
FIGS. 19(*a*) to 19(*c*) are views showing an example of the air conditioning indoor unit pertaining to example modification 2A during operation, with FIG. 19(*a*) being a front view of the air conditioning indoor unit, FIG. 19(*b*) being a side view of the air conditioning indoor unit, and FIG. 19(*c*) being a schematic view showing a flow of the outlet air on the outside surface of the Coanda blade.
Figure 20:
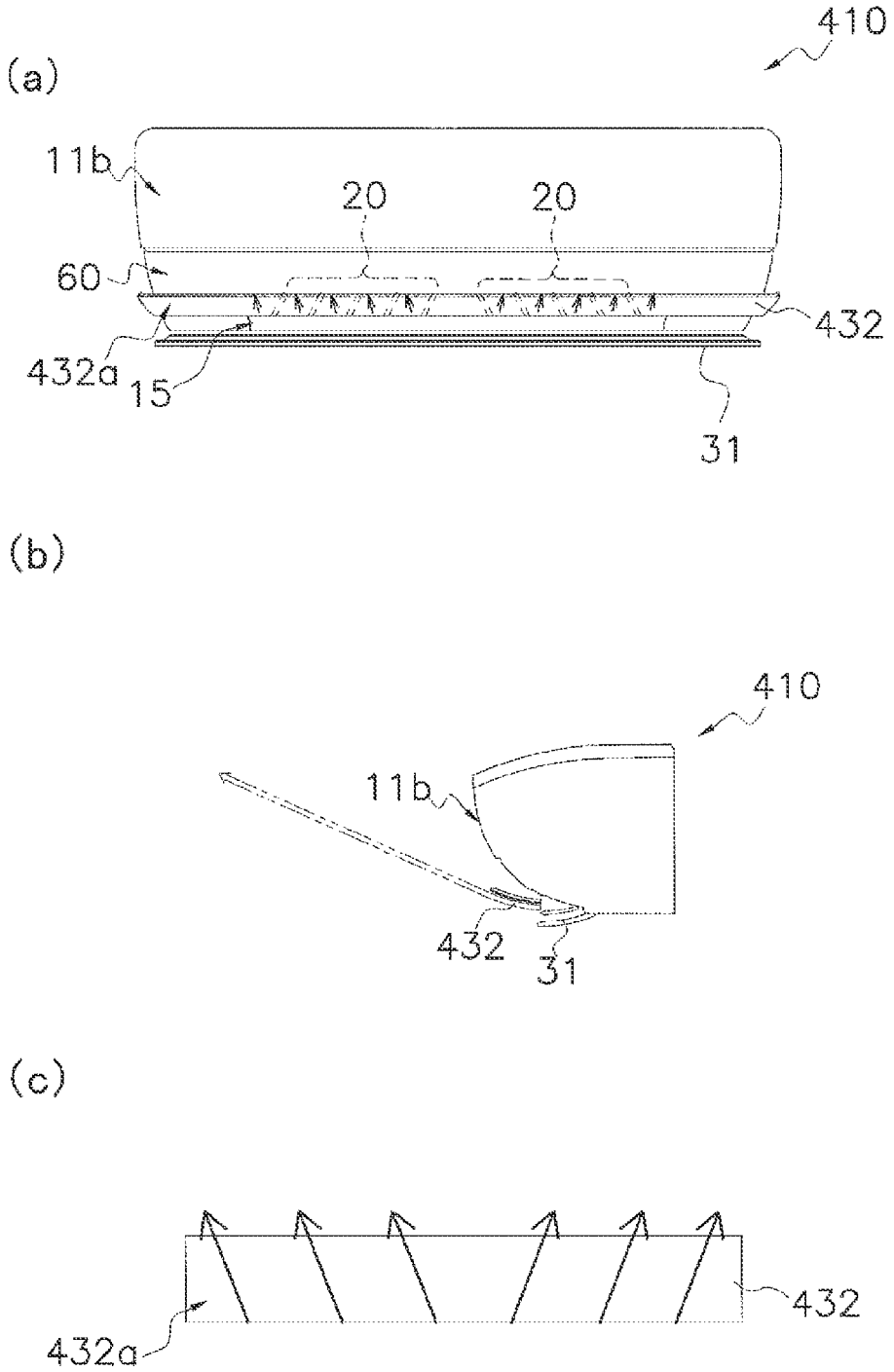
FIGS. 20(*a*) to 20(*c*) are views showing an example of the air conditioning indoor unit pertaining to example modification 2A during operation, with FIG. 20(*a*) being a front view of the air conditioning indoor unit, FIG. 20(*b*) being a side view of the air conditioning indoor unit, and FIG. 20(*c*) being a schematic view showing a flow of the outlet air on the outside surface of the Coanda blade.

FIGS. 19(*a*) to 19(*c*) and FIGS. 20(*a*) to 20(*c*) are views showing examples of the Coanda airflow utilization mode of the air conditioning indoor unit 410, with FIG. 19(*a*) and FIG. 20(*a*) being front views of the air conditioning indoor unit, FIG. 19(*b*) and FIG. 20(*b*) being side views, and FIG. 19(*c*) and FIG. 20(*c*) being views of flows of the outlet air on the outside surface 432*a* of the Coanda blade 432.

In the above embodiment, an air direction utilizing a Coanda airflow and an air direction not utilizing a Coanda airflow are simultaneously formed by fixing the posture of the vertical blades 20 to the forward blowing posture in which the outlet air is blown out in a forward direction from the air outlet 15 and changing the combination of the postures of the Coanda blade 432 and the horizontal blade 31 in such a way that the relative angle between the Coanda blade 432 and the horizontal blade 31 becomes different.

Instead of this, an air direction utilizing a Coanda airflow and an air direction not utilizing a Coanda airflow may also be simultaneously formed by changing the posture of the vertical blades 20 without changing the combination of the postures of the Coanda blade 432 and the horizontal blade 31.

Here, if the posture of the vertical blades 20 in which the outlet air is blown out in rightward and leftward directions (both rightward and leftward directions with respect to the forward direction) from the air outlet 15 is defined as a lateral blowing posture with respect to the forward blowing posture that is the posture of the vertical blades 20 in which the outlet air is blown out in the forward direction (front direction) from the air outlet 15, when the posture of the vertical blades 20 is changed from the forward blowing posture to the lateral blowing posture, the air speed of the outlet air blown out from the central section of the air outlet 15 becomes slower compared to the air speed of the outlet air blown out from both end portions of the air outlet 15. That is, in a case where the outlet air is being blown out in rightward and leftward directions from the air outlet 15, the air speed of the outlet air becomes partially lower.

Additionally, even when the relative angle between the Coanda blade 432 and the horizontal blade 31 is in an angle at which a stable Coanda airflow is produced on the entire region of the outside surface 432*a* of the Coanda blade 432 when the vertical blades 20 are assuming the forward blowing posture, by switching the posture of the vertical blades 20 to the lateral blowing posture, sometimes Coanda airflows are produced on both end portions of the outside surface 432*a* of the Coanda blade 432, but on the central section of the outside surface 432*a* of the Coanda blade 432, the outlet air cannot attach to the outside surface 432*a* and becomes an unstable airflow in which a Coanda airflow is not produced (see FIGS. 19(*a*) to 19(*c*)).

Moreover, when the relative angle between the Coanda blade 432 and the horizontal blade 31 is gradually reduced when the posture of the vertical blades 20 is the lateral blowing posture and a Coanda airflow along the outside surface 432*a* is produced on both end portions of the outside surface 432*a* of the Coanda blade 432 but an unstable airflow in which a Coanda airflow is not produced is being produced on the central section of the outside surface 432*a* of the Coanda blade 432, even if the posture of the vertical blades 20 is the lateral blowing posture, a stable Coanda airflow is produced on the entire region of the outside surface 432*a* of the Coanda blade 432 (see FIGS. 20(*a*) to 20(*c*)).

This will be described in greater detail using FIG. 21, which is a drawing for describing the relationship between the outlet air and combinations (blade angle combinations) of postures of the Coanda blade 432 and the horizontal blade 31.

Figure 21:
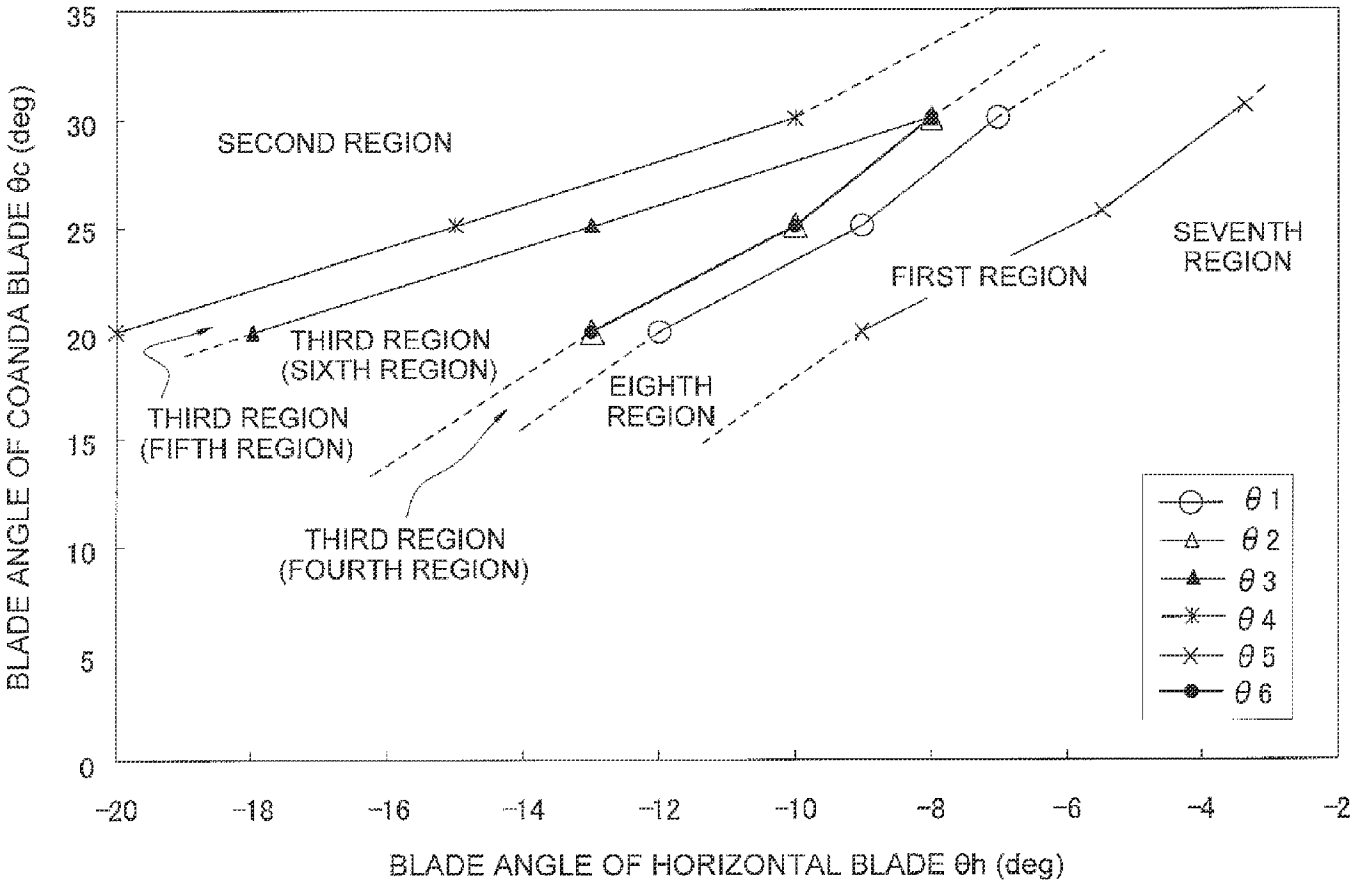
FIG. 21 is a drawing for describing the relationship between the outlet air and the blade angles of the Coanda blade and the horizontal blade.

In FIG. 21, θ1 represents a blade angle combination of the Coanda blade 432 and the horizontal blade 31 when the airflow state has been a switch from the third airflow state to the first airflow state in a state in which the vertical blades 20 are fixed in the forward blowing posture, θ2 represents a blade angle combination of the Coanda blade 432 and the horizontal blade 31 when the airflow state has been a switch from the first airflow state to the third airflow state in a state in which the vertical blades 20 are fixed in the forward blowing posture, θ3 represents a blade angle combination of the Coanda blade 432 and the horizontal blade 31 when the airflow state has been a switch from the second airflow state to the third airflow state in a state in which the vertical blades 20 are fixed in the forward blowing posture, θ4 represents a blade angle combination of the Coanda blade 432 and the horizontal blade 31 when the airflow state has been a switch from the third airflow state to the second airflow state in a state in which the vertical blades 20 are fixed in the forward blowing posture, θ5 represents a blade angle combination of the Coanda blade 432 and the horizontal blade 31 when the airflow state has been a switch from the third airflow state to the first airflow state in a state in which the vertical blades 20 are fixed in the lateral blowing posture, and θ6 represents a blade angle combination of the Coanda blade 432 and the horizontal blade 31 when the airflow state has been a switch from the first airflow state to the third airflow state in a state in which the vertical blades 20 are fixed in the lateral blowing posture. Furthermore, the blade angle θh of the horizontal blade 31 shown in FIG. 21 is, as shown in FIG. 18, an angle between the horizontal line and the straight line Lh joining the front and rear ends of the outside surface 31*a* of the horizontal blade 31. Additionally, the blade angle θc of the Coanda blade 432 shown in FIG. 21 is an angle between the horizontal line and the straight line Lc joining the front and rear ends of the outside surface 432*a* of the Coanda blade 432. Here, the blade angle θh and the blade angle θc are not absolute values and are negative values in a case where they become lower than the horizontal line. Additionally, the open angle (relative angle) 0 between the horizontal blade 31 and the Coanda blade 432 can be given by the equation θ=θc−θh.

FIG. 21 shows results of having performed an evaluation test by fixing, without changing, the air volume of the indoor fan 14 at a predetermined air volume and changing the blade angle (posture) of the horizontal blade 31 with respect to the Coanda blade 432.

Additionally, as described also in the second embodiment, as blade angle combinations of the Coanda blade 432 and the horizontal blade 31 in a case where the posture of the vertical blades 20 is the forward blowing posture, between the first region that is a blade angle combination region that results in the first airflow state and the second region that is a blade angle combination region that results in the second airflow state, there exists the third region that is a blade angle combination region that results in the third airflow state. Moreover, in the third region, there exist hysteresis regions (the fourth region and the fifth region).

Additionally, for example, when the blade angle θh of the horizontal blade 31 is gradually increased (so as to become closer to 0 degrees) from −12 degrees in a state in which the vertical blades 20 are fixed in the lateral blowing posture and the blade angle θc of the Coanda blade 432 is fixed at 25 degrees, the airflow state is a switch from the third airflow state to the first airflow state when the blade angle θh of the horizontal blade 31 becomes −5 degrees. On the other hand, when the blade angle θh of the horizontal blade 31 is gradually decreased (so as to become farther away from 0 degrees) from −4 degrees in a state in which the vertical blades 20 are fixed in the lateral blowing posture and the blade angle θc of the Coanda blade 432 is fixed at 25 degrees, the airflow state is a switch from the first airflow state to the third airflow state when the blade angle θh of the horizontal blade 31 becomes −10 degrees.

In this way, also in a case where the posture of the vertical blades 20 is the lateral blowing posture, as blade angle combinations of the Coanda blade 432 and the horizontal blade 31, there exists a blade angle combination region that results in the first airflow state (a blade angle combination region in which the relative angle between the Coanda blade 432 and the horizontal blade 31 is smaller than in the blade angle combination θ5 shown in FIG. 21; hereinafter called a seventh region).

Moreover, in a case where the vertical blades 20 assume the lateral blowing posture, the relative angle of the blade angle combination θ5 when transitioning from the third airflow state to the first airflow state and the relative angle of the blade angle combination θ6 when transitioning from the first airflow state to the third airflow state are different, so there exist hysteresis regions also in a case where the vertical blades 20 assume the lateral blowing posture. Also in a case where the vertical blades 20 assume the lateral blowing posture, in the range in which the angle is greater than the relative angle of the blade angle combination θ6, the third airflow state is maintained until the angle becomes a predetermined angle.

From the above, it was understood that the blade angle combination of the Coanda blade 432 and the horizontal blade 31 when transitioning from the third airflow state to the first airflow state differs depending on a case where the vertical blades 20 assume the forward blowing posture and a case where the vertical blades 20 assume the lateral blowing posture. Specifically, in a case where the vertical blades 20 assume the forward blowing posture, the blade angle combination of the Coanda blade 432 and the horizontal blade 31 when transitioning from the third airflow state to the first airflow state is the blade angle combination θ1 shown in FIG. 21. but in a case where the vertical blades 20 assume the lateral blowing posture, the blade angle combination of the Coanda blade 432 and the horizontal blade 31 when transitioning from the third airflow state to the first airflow state is the blade angle combination θ5 shown in FIG. 21.

Additionally, the time when the airflow state becomes the first airflow state when the vertical blades 20 assume the forward blowing posture is a time when the blade angle combination of the Coanda blade 432 and the horizontal blade 31 is in a predetermined blade angle combination in the first region that is a blade angle combination region in which the relative angle is smaller than the relative angle of the blade angle combination θ1, but the time when the airflow state becomes the first airflow state when the vertical blades 20 assume the lateral blowing posture is a time when the blade angle combination of the Coanda blade 432 and the horizontal blade 31 is in a predetermined blade angle combination in the seventh region that is a blade angle combination region in which the relative angle is smaller than the relative angle of the blade angle combination θ5.

From this, it was found that the angular range of the relative angle between the Coanda blade 432 and the horizontal blade 431 in which a stable Coanda airflow is produced on the entire region of the outside surface 432*a* of the Coanda blade 432 is different depending on the posture of the vertical blades 20 and that parts of those angular ranges overlap. Specifically, the first region is greater than the seventh region, and the first region and the seventh region overlap in the region where the relative angle is smaller than in the blade angle combination θ5. Additionally, as for upper limit angles of the angular ranges of the relative angle between the Coanda blade 432 and the horizontal blade 31 in which a stable Coanda airflow is produced on the entire region of the outside surface 432*a* of the Coanda blade 432, the first angular range that is an angular range in a case where the vertical blades 20 assume the forward blowing posture is greater than the angular range (hereinafter called a seventh angular range) in a case where the vertical blades 20 assume the lateral blowing posture, and it can be said that the first angular range is wider in range than the seventh angular range by an amount corresponding to the angular range (hereinafter called an eighth angular range) between the upper limit angle of the first angular range and the upper limit angle of the seventh angular range.

Additionally, in a case where the relative angle between the Coanda blade 432 and the horizontal blade 31 is a predetermined angle in the eighth angular range, if the vertical blades 20 are assuming the forward blowing posture, a stable Coanda airflow is produced on the entire region of the outside surface 432*a* of the Coanda blade 432, but if the vertical blades 20 are assuming the lateral blowing posture, Coanda airflows along the outside surface 432*a* are produced on both end portions of the outside surface 432*a* of the Coanda blade 432, but on the central section of the outside surface 432*a* of the Coanda blade 432, the outlet air becomes an unstable airflow in which a Coanda airflow is not produced.

Therefore, by setting the postures of the Coanda blade 432 and the horizontal blade 31 to predetermined postures in a blade angle combination region (hereinafter called an eighth region) in which the relative angle between the Coanda blade 432 and the horizontal blade 31 becomes a predetermined angle in the eighth angular range, in a case where the "Coanda airflow ceiling blowing" or the "Coanda airflow forward blowing" that generate a stable Coanda airflow on the entire region of the outside surface 432*a* of the Coanda blade 432 has been selected, by changing the posture of the vertical blades 20 to the forward blowing posture, all of the outlet air can be changed to a Coanda airflow. On the other hand, in a case where "partial ceiling blowing" or "dehumidification capability enhancement blowing" that generate a Coanda airflow on part of the outside surface 432*a* of the Coanda blade 432 but do not generate a Coanda airflow on other parts has been selected, by changing the posture of the vertical blades 20 to the lateral blowing posture, it can be brought about that some of the outlet air is changed to a Coanda airflow while the rest of the outlet air is not changed to a Coanda airflow.

Furthermore, when the posture of the vertical blades 20 changes, the region of the blade angle combination of the Coanda blade 432 and the horizontal blade 31 in which a Coanda airflow is produced on part of the outside surface 432*a* of the Coanda blade 432 and the rest of the outlet air becomes an unstable airflow in which a Coanda airflow is not produced on other parts changes, so the angles of the blade pieces 21 of the vertical blades 20 (hereinafter called the blade angle of the vertical blades 20) assuming the lateral blowing posture may also be set to different angles between the case of producing a Coanda airflow on the entire region of the outside surface 432*a* of the Coanda blade 432 or the case of not producing a Coanda airflow on the entire region of the outside surface 432*a* of the Coanda blade 432 and the case of producing a Coanda airflow on part of the outside surface 432*a* of the Coanda blade 432 and not producing a Coanda airflow on other parts.

For example, the blade angle of the vertical blades 20 assuming the lateral blowing posture with respect to the vertical blades 20 assuming the forward blowing posture may be set in such a way as to become smaller during execution of the modes ("partial ceiling blowing" and "dehumidification capability enhancement blowing") that produce a Coanda airflow on part of the outside surface 432*a* of the Coanda blade 432 but do not produce a Coanda airflow on other parts than during execution of the modes ("Coanda airflow ceiling blowing" and "Coanda airflow forward blowing") that produce a Coanda airflow on the entire region of the outside surface 432*a* of the Coanda blade 432 and the modes ("normal forward blowing" and "normal forward and downward blowing") that do not produce a Coanda airflow on the outside surface 432*a* of the Coanda blade 432.

Figure 22:
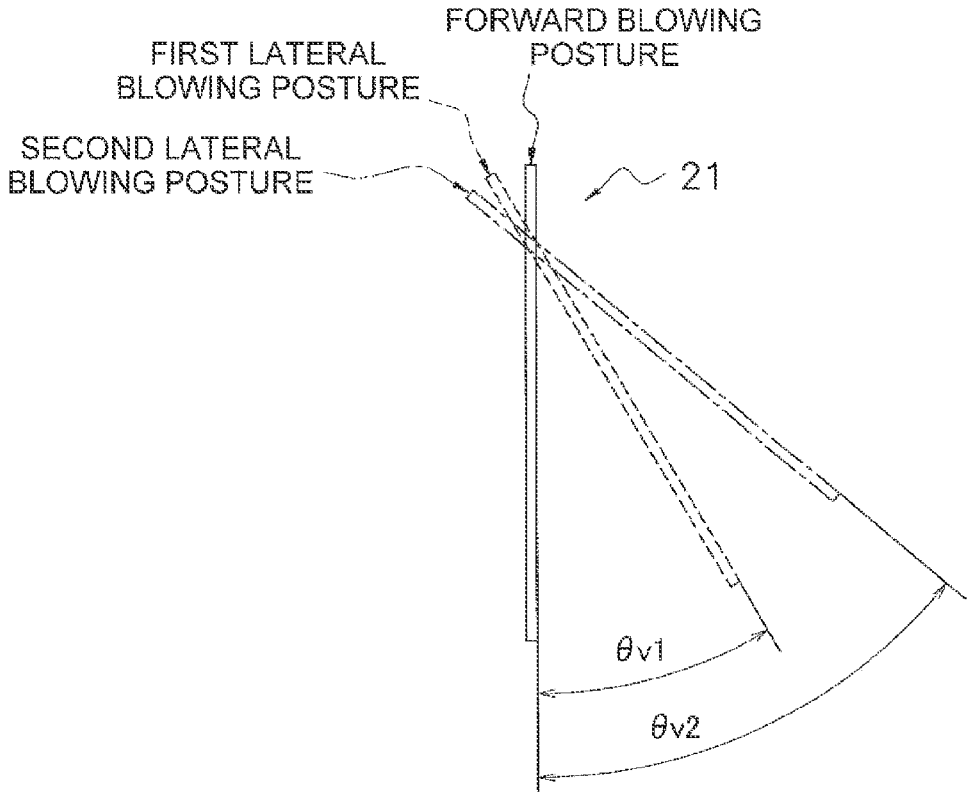
FIG. 22 is a drawing for describing postures assumed by vertical blades and blade angles of the vertical blades.

Specifically, among lateral blowing postures, if the posture of the vertical blades 20 during execution of the modes ("partial ceiling blowing" and "dehumidification capability enhancement blowing") that produce a Coanda airflow on part of the outside surface 432*a* of the Coanda blade 432 but do not produce a Coanda airflow on other parts is defined as a first lateral blowing posture and the posture of the vertical blades 20 during execution of the modes ("Coanda airflow ceiling blowing," "Coanda airflow forward blowing," "normal forward blowing," and "normal forward and downward blowing") that produce a Coanda airflow on the entire region of the outside surface 432*a* of the Coanda blade 432 or do not produce a Coanda airflow on the entire region of the outside surface 432*a* of the Coanda blade 432 is defined as a second lateral blowing posture, as shown in FIG. 22, an angle θv1 that is an angle formed by the blade pieces 21 of the vertical blades 20 assuming the forward blowing posture and the blade pieces 21 of the vertical blades 20 assuming the first lateral blowing posture is set in such a way as to be smaller than an angle θv2 that is an angle formed by the blade pieces 21 of the vertical blades 20 assuming the forward blowing posture and the blade pieces 21 of the vertical blades 20 assuming the second lateral blowing posture.

Because of this, compared to a case where the blade angle of the vertical blades 20 assuming the lateral blowing posture is not set to different blade angles in accordance with the executed mode, that is, a case where the angle formed by the blade pieces 21 of the vertical blades 20 assuming the forward blowing posture and the blade pieces 21 of the vertical blades 20 assuming the lateral blowing posture is set to the angle θv2 during execution of all of the modes, the region of the blade angle combination of the Coanda blade 432 and the horizontal blade 31 in which the outlet air becomes a Coanda airflow on part of the outside surface 432*a* of the Coanda blade 432 but becomes unstable airflows not resulting in a Coanda airflow on other parts of the outside surface 432*a* of the Coanda blade 432 can be made smaller. That is, the region of the blade angle combination of the Coanda blade 432 and the horizontal blade 31 in which a Coanda airflow is produced on the entire region of the outside surface 432*a* of the Coanda blade 432 can be made larger. Because of this, the concern that, during execution of a mode other than a mode that forms an unstable airflow that changes just some of the outlet air to a Coanda airflow, some of the outlet air will become a Coanda airflow can be reduced.

In this way, because the control unit changes the posture of the vertical blades 20, just an air direction utilizing a Coanda airflow can be formed, or an air direction utilizing a Coanda airflow and an air direction not utilizing a Coanda airflow can be simultaneously formed.

Consequently, in the Coanda airflow utilization mode, the number of variations of air directions can be increased compared to an air conditioning indoor unit in which only an air direction that changes all of the outlet air to a Coanda airflow is formed.

Moreover, when simultaneously forming an air direction utilizing a Coanda airflow and an air direction not utilizing a Coanda airflow, the outlet air is blown out in right and left directions from the air outlet 15, so an enveloping airflow from the up, down, right, and left directions can be created.

Furthermore, in a case where an air direction utilizing a Coanda airflow and an air direction not utilizing a Coanda airflow are simultaneously formed, by setting the postures of the Coanda blade 432 and the horizontal blade 31 in such a way that the Coanda airflow is guided to the neighborhood of the air inlet 19, just the portion of the outlet air that has become the Coanda airflow can be short-circuited, so the dehumidification capability can be enhanced with the portion of the outlet air that has been short-circuited while the room can be air conditioned with the rest of the outlet air.

Moreover, the Coanda blade 432 and the horizontal blade 31 are not divided into two or more blades, so the air conditioning indoor unit can be manufactured at a lower cost compared to a case where the Coanda blade 432 is divided into two or more blades to simultaneously form an air direction utilizing a Coanda airflow and an air direction not utilizing a Coanda airflow like in the air conditioning indoor unit 10 of the first embodiment or where the horizontal blade 31 is divided into two or more blades to simultaneously form an air direction utilizing a Coanda airflow and an air direction not utilizing a Coanda airflow.

INDUSTRIAL APPLICABILITY

The present invention relates to an air conditioning indoor unit that can form diverse variations of air directions by simultaneously forming an air direction utilizing a Coanda airflow and an air direction not utilizing a Coanda airflow, and the present invention is effectively applied to an air conditioning indoor unit in which a Coanda blade and a horizontal blade cooperate with one another to form a Coanda airflow.

What is claimed is:

1. An airflow direction control device of an air conditioning indoor unit comprising:

a casing having an air outlet formed therein;

a horizontal blade arranged and configured to change a posture thereof by rotating and to change an up and down direction flow of outlet air blown out from the air outlet formed in the casing, the horizontal blade having a first surface which faces inwardly relative to the casing and causes the outlet air to flow in a direction transverse to a lengthwise direction of the air outlet, and the horizontal blade being positioned at a bottom of the air outlet such that airflow only flows on the first surface;

a Coanda blade arranged and configured to change a posture thereof by rotating and to cooperate with the first surface of the horizontal blade in order to utilize the Coanda effect to change the outlet air to a Coanda airflow along an outside surface of the Coanda blade, the Coanda blade being disposed above the horizontal blade, the Coanda blade including a first Coanda blade and a second Coanda blade that are disposed in a lengthwise direction of the Coanda blade;

a first motor configured to drive the horizontal blade;

a second motor configured to independently drive the first Coanda blade and the second Coanda blade; and a control unit configured to control the first motor and the second motor to change postures of the Coanda blade and the horizontal blade to predetermined postures that change some of the outlet air to the Coanda airflow and do not change a remainder of the outlet air to the Coanda airflow by keeping the remainder of the outlet air to an airflow along the first surface of the horizontal blade, the control unit being further configured to control the first motor and the second motor to change the postures of the Coanda blade and the horizontal blade to first postures in which a relative angle between the Coanda blade and the horizontal blade is set to an angle smaller than a predetermined angle and second postures in which the relative angle between the Coanda blade and the horizontal blade is set to an angle greater than the predetermined angle so as to cause the some of the outlet air which is a Coanda airflow and the remainder of the outlet air which is not a Coanda airflow to exist along the lengthwise direction of the air outlet.

2. The airflow direction control device of an air conditioning indoor unit according to claim 1, wherein combinations of the postures of the Coanda blade and the horizontal blade include a combination in which the Coanda airflow is produced on part of the Coanda blade and the Coanda airflow is not produced on other parts of the Coanda blade.

3. The airflow direction control device of an air conditioning indoor unit according to claim 2, further comprising vertical blades arranged and configured to change a right and left direction flow of the outlet air and to assume a forward blowing posture in which the outlet air is blown out in a forward direction from the air outlet and a lateral blowing posture in which the outlet air is blown out in rightward and leftward directions from the air outlet, the control unit being further configured to change the posture of the vertical blades to the lateral blowing posture when the postures of the Coanda blade and the horizontal blade are changed to the predetermined postures included in the combination in which the Coanda airflow is produced on part of the Coanda blade and the Coanda airflow is not produced on other parts of the Coanda blade.

4. The airflow direction control device of an air conditioning indoor unit according to claim 3, wherein the control unit is further configured to, by changing the postures of the Coanda blade and the horizontal blade and the posture of the vertical blades, execute a partial Coanda blowing mode that changes some of the outlet air to the Coanda airflow and does not change the remainder of the outlet air to the Coanda airflow and a normal blowing mode that changes all of the outlet air to the Coanda airflow or does not change any of the outlet air to the Coanda airflow, and a blade angle of the vertical blades assuming the lateral blowing posture with respect to the vertical blades assuming the forward blowing posture is smaller during execution of the partial Coanda blowing mode than during execution of the normal blowing mode.

5. The airflow direction control device of an air conditioning indoor unit according to claim 1, wherein the horizontal blade includes a first horizontal blade and a second horizontal blade that are disposed in a lengthwise direction of the horizontal blade, and the first motor is further configured to independently drive the first horizontal blade and the second horizontal blade.

6. The airflow direction control device of an air conditioning indoor unit according to claim 1, wherein a dimension in a lengthwise direction of the Coanda blade is shorter than a dimension in the lengthwise direction of the air outlet.

7. The airflow direction control device of an air conditioning indoor unit according to claim 1, wherein the casing has an air inlet formed above the air outlet that is configured and arranged to suck in air, and the outlet air that has become the Coanda airflow is guided to the air inlet.

8. An airflow direction control device of an air conditioning indoor unit comprising:

a casing having an air outlet formed therein;

a horizontal blade arranged and configured to change a posture thereof by rotating and to change an up and down direction flow of outlet air blown out from the air outlet formed in the casing, the horizontal blade having a first surface which faces inwardly relative to the casing and causes the outlet air to flow in a direction transverse to a lengthwise direction of the air outlet, the horizontal blade being positioned at a bottom of the air outlet such that airflow only flows on the first surface, the horizontal blade including a first horizontal blade and a second horizontal blade that are disposed in a lengthwise direction of the horizontal blade;

a Coanda blade arranged and configured to change a posture thereof by rotating and to cooperate with the first surface of the horizontal blade in order to utilize the Coanda effect to change the outlet air to a Coanda airflow along an outside surface of the Coanda blade, the Coanda blade being disposed above the horizontal blade;

a first motor configured to independently drive the first horizontal blade and the second horizontal blade;

a second motor configured to drive the Coanda blade; and a control unit configured to control the first motor and the second motor to change postures of the Coanda blade and the horizontal blade to predetermined postures that change some of the outlet air to the Coanda airflow and do not change a remainder of the outlet air to the Coanda airflow by keeping the remainder of the outlet air to an airflow along the first surface of the horizontal blade, the control unit being further configured to control the first motor and the second motor to change the postures of the Coanda blade and the horizontal blade to first postures in which a relative angle between the Coanda blade and the horizontal blade is set to an angle smaller than a predetermined angle and second postures in which the relative angle between the Coanda blade and the horizontal blade is set to an angle greater than the predetermined angle so as to cause the some of the outlet air which is a Coanda airflow and the remainder of the outlet air which is not a Coanda airflow to exist along the lengthwise direction of the air outlet.

9. The airflow direction control device of an air conditioning indoor unit according to claim 8, wherein combinations of the postures of the Coanda blade and the horizontal blade include a combination in which the Coanda airflow is produced on part of the Coanda blade and the Coanda airflow is not produced on other parts of the Coanda blade.

10. The airflow direction control device of an air conditioning indoor unit according to claim 9, further comprising vertical blades arranged and configured to change a right and left direction flow of the outlet air and to assume a forward blowing posture in which the outlet air is blown out in a forward direction from the air outlet and a lateral blowing posture in which the outlet air is blown out in rightward and leftward directions from the air outlet, the control unit being further configured to change the posture of the vertical blades to the lateral blowing posture when the postures of the Coanda blade and the horizontal blade are changed to the predetermined postures included in the combination in which the Coanda airflow is produced on part of the Coanda blade and the Coanda airflow is not produced on other parts of the Coanda blade.

11. The airflow direction control device of an air conditioning indoor unit according to claim 10, wherein the control unit is further configured to, by changing the postures of the Coanda blade and the horizontal blade and the posture of the vertical blades, execute a partial Coanda blowing mode that changes some of the outlet air to the Coanda airflow and does not change the remainder of the outlet air to the Coanda airflow and a normal blowing mode that changes all of the outlet air to the Coanda airflow or does not change any of the outlet air to the Coanda airflow, and a blade angle of the vertical blades assuming the lateral blowing posture with respect to the vertical blades assuming the forward blowing posture is smaller during execution of the partial Coanda blowing mode than during execution of the normal blowing mode.

12. The airflow direction control device of an air conditioning indoor unit according to claim 8, wherein a dimension in a lengthwise direction of the Coanda blade is shorter than a dimension in the lengthwise direction of the air outlet.

13. The airflow direction control device of an air conditioning indoor unit according to claim 8, wherein the casing has an air inlet formed above the air outlet that is configured and arranged to suck in air, and the outlet air that has become the Coanda airflow is guided to the air inlet.

14. The airflow direction control device of an air conditioning indoor unit according to claim 8, wherein the Coanda blade includes a first Coanda blade and a second Coanda blade that are disposed in a lengthwise direction of the Coanda blade, and the second motor is further configured to independently drive the first Coanda blade and the second Coanda blade.

* * * * *